US008049691B2

(12) United States Patent
Pan et al.

(10) Patent No.: US 8,049,691 B2
(45) Date of Patent: Nov. 1, 2011

(54) SYSTEM FOR DISPLAYING IMAGES ON A DISPLAY

(75) Inventors: Hao Pan, Urbana, IL (US); Xiao-Fan Feng, Vancouver, WA (US); Scott J. Daly, Kalama, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 1452 days.

(21) Appl. No.: 10/676,312

(22) Filed: Sep. 30, 2003

(65) Prior Publication Data

US 2005/0068343 A1 Mar. 31, 2005

(51) Int. Cl.
*G09G 3/36* (2006.01)

(52) U.S. Cl. ..... 345/87; 345/88; 345/90; 345/95; 345/690

(58) Field of Classification Search ..... 345/87–104, 345/690–696, 204–214, 589, 618; 349/172; 340/767

See application file for complete search history.

(56) References Cited

U.S. PATENT DOCUMENTS

| | | | | |
|---|---|---|---|---|
| 5,293,159 | A * | 3/1994 | Bassetti et al. | 345/691 |
| 5,434,622 | A * | 7/1995 | Lim | 348/400.1 |
| 5,461,397 | A | 10/1995 | Zhang | |
| 5,471,225 | A | 11/1995 | Parks | |
| 5,976,086 | A * | 11/1999 | Matsushima | 600/443 |
| 6,288,695 | B1 * | 9/2001 | Wood | 345/75.2 |
| 6,621,476 | B2 * | 9/2003 | Walton et al. | 345/87 |
| 6,624,800 | B2 * | 9/2003 | Hughes et al. | 345/88 |
| 6,778,160 | B2 * | 8/2004 | Kubota et al. | 345/89 |
| 7,012,591 | B2 * | 3/2006 | Chen et al. | 345/88 |
| 7,034,793 | B2 * | 4/2006 | Sekiya et al. | 345/98 |
| 7,046,262 | B2 * | 5/2006 | Feng et al. | 345/691 |
| 7,190,340 | B2 * | 3/2007 | Sugino | 345/98 |
| 7,312,820 | B2 * | 12/2007 | Zimmermann et al. | 348/218.1 |
| 2001/0005192 | A1 * | 6/2001 | Walton et al. | 345/87 |
| 2001/0024199 | A1 | 9/2001 | Hughes | |
| 2002/0003522 | A1 | 1/2002 | Baba et al. | |
| 2002/0024017 | A1 * | 2/2002 | Overdick et al. | 250/370.11 |
| 2002/0024107 | A1 * | 2/2002 | Inaba | 257/408 |
| 2002/0149574 | A1 | 10/2002 | Johnson | |
| 2002/0154088 | A1 | 10/2002 | Nishimura | |
| 2002/0175907 | A1 * | 11/2002 | Sekiya et al. | 345/211 |
| 2003/0000949 | A1 | 1/2003 | Dhellemmes | |
| 2003/0006949 | A1 * | 1/2003 | Sekiya et al. | 345/87 |
| 2003/0058264 | A1 | 3/2003 | Takako et al. | |

(Continued)

FOREIGN PATENT DOCUMENTS

| | | |
|---|---|---|
| EP | 04 02 3233 | 2/2007 |

(Continued)

OTHER PUBLICATIONS

H. Kobayashi, M. Baba, & H. Okumura, et al., "Feedback Level-Adaptive Overdrive (FB-LAO) Method for Multi-Media LCDs," Display materials and Devices Laboratory, Corporate R&D Center, Toshiba Corp., 1, Komukai Toshiba-cho, Saiwai-ku, Kawasaki 212-8582, Japan, 4 pages, 2002.

(Continued)

*Primary Examiner* — Prabodh Dharia
*Assistant Examiner* — Vince E Kovalick
(74) *Attorney, Agent, or Firm* — Chernoff Vilhauer McClung & Stenzel LLP

(57) ABSTRACT

Processing of images for displaying on a display for displaying images on a liquid crystal display.

4 Claims, 13 Drawing Sheets

U.S. PATENT DOCUMENTS

| | | | | |
|---|---|---|---|---|
| 2003/0080931 | A1* | 5/2003 | Chen et al. | 345/88 |
| 2003/0137527 | A1* | 7/2003 | Lin et al. | 345/698 |
| 2003/0156092 | A1* | 8/2003 | Suzuki et al. | 345/98 |
| 2003/0169247 | A1 | 9/2003 | Kawabe | |
| 2003/0222836 | A1* | 12/2003 | Wong | 345/87 |
| 2004/0012551 | A1 | 1/2004 | Ishii | |
| 2004/0140985 | A1* | 7/2004 | Liaw | 345/690 |
| 2004/0189680 | A1* | 9/2004 | Feng et al. | 345/691 |
| 2005/0068343 | A1* | 3/2005 | Pan et al. | 345/690 |

FOREIGN PATENT DOCUMENTS

| | | | |
|---|---|---|---|
| JP | 64-010299 | | 1/1989 |
| JP | 64-10299 | | 1/1989 |
| JP | 01010299 | | 1/1989 |
| JP | 2003-174186 | | 7/1991 |
| JP | 07-020828 | | 1/1995 |
| JP | 7-56532 | | 3/1995 |
| JP | 2007-129133 | | 5/1995 |
| JP | 2007-334123 | | 12/1995 |
| JP | 2523594 | * | 5/1996 |
| JP | 9-106262 | | 4/1997 |
| JP | 11-219153 | | 8/1999 |
| JP | 11-271710 | | 10/1999 |
| JP | 11-326868 | | 11/1999 |
| JP | 2002-099249 | | 4/2002 |
| JP | 2003-172915 | | 6/2003 |
| WO | WO 2004 013835 | | 2/2004 |

OTHER PUBLICATIONS

D. Nakano and T. Minami, "Fast Response IPS-LCD Using Feed-Backward Overdrive Technology," IDW '02, Proceedings of The Ninth International Display Workshops, The Institute of Image Information and Television Engineers and The Socity for Information Disply, 5 pages, 2002.

Office Action issued Apr. 13, 2010 in co-pending Japanese Patent Application No. 2004-278838; pp. 1-2.

Following *NPL* References and Foreign Patent Documents Listed Above Were Cited by Examiner in Apr. 13, 2010 Japanese Office Action.

English Abstract of Japanese Publication No. 2007-129133; Applicant—Casio Comput Co Ltd.; published May 19, 1995; 1 pg.

English Abstract of Japanese Publication No. 2007-334123; Applicant—Casio Comput Co Ltd.; published Dec. 22, 1995; 1 pg.

English Abstract of Japanese Publication No. 2003-174186; Applicant—Casio Comput Co Ltd.; published Jul. 29, 1991; 1 pg.

Amendment to Japanese Publication No. 2003-174186, dated Mar. 18, 1994; 1 pg.

Office Action issued Jun. 29, 2010 in co-pending Japanese Patent Application No. 2004-278838; 1 pg.

Following *NPL* References and Foreign Patent Documents Listed Above Were Cited by Examiner in Jun. 29, 2010 Japanese Office Action.

English Abstract of Japanese Publication No. 11-271710; Applicant—Olympus Optical Co. Ltd.; published Oct. 8, 1999; 1 pg.

English Abstract of Japanese Publication No. 2002-99249; Applicant—Advanced Display Inc.; published Apr. 5, 2002; 1 pg.

Amendment filed Sep. 16, 2004 in co-pending Japanese Patent Application No. 2004-278838; pp. 1-6.

A.A.S. Sluyterman and E.P. Boonekamp, "Architectural Choices in a Scanning Backlight for Large LCD TVs," 18.2 SID 05 Digest, 2005, ISSN/0005-0966X/05/3602-0996, pp. 996-999, Philips Lighting, Eindhoven, The Netherlands.

K. Nakanishi, S. Takahasi, et al., *Fast Response 15-in. XGA TFT-LCD With Feedforward Driving(FFD) Technology for Multimedia Applications*, SID 01 Digest, pp. 488-491, 2001.

J. Someya, M. Yamakawa, et. al., *Late-News Paper: Reduction of Memory Capacity in Feedforward Driving by Image Compression*, SID 02 Digest, pp. 72-75, 2002.

K. Sekiya and H. Nakamura, *Overdrive Method for TN-made LCDs-Recursive System With Capacilance Prediction*. SID 01 Digest, pp. 114-117, 2001.

H. Nakamura and K. Sekiya, *Overdrive Method for Reducing Response Times of Liquid Crystals*. SID 01 Digest, pp. 1256-1259, 2001.

K. Kawabe, T. Furuhasi and Y. Tanaka, *New TFT-LCD Driving Method for Improved Moving Picture Quality*, SID 01 Digest, pp. 998-1001, 2001.

T. Furuhasi and K. Kawabe, *High Quality TFT-LCD System for Moving Picture*, SID Digest, pp. 1284-1287, 2002.

H. Nakamura, J. Crain and K. Sekiya, *Computational Optimization of Active-Matrix Drives for Liquid Crystal Displays*, IDW '00, pp. 81-84, 2000.

T. Yamamoto, Y. Aono and M. Tsumura, *Guiding Principles for High Quality Motion Picture in AMLCDs Applicable to TV Monitors*, SID 00 Digest, pp. 456-459, 2000.

K. Kumagawa and A. Takimoto, *Invited Paper: Fast Response OCB-LCD for TV Applications*, SID 02 Diglest, pp. 1288-1291, 2002.

B. Lee, C. Park et. al.,*Reducing Gray-Level Response to One Frame: Dynamic Capacitance Compensation*, SID 01 Digest. pp. 1260-1263, 2001.

B. Rho, et al., *A New Driving Method for Faster Response of TFT LCD on the Basis of Equilibrium Charge Injection*, IDW '00, pp. 1155-1156, 2000.

H. Okumura, M. Baba, et. al., *Advanced Level Adaptive Overdrive(ALAO) Method Application to Full HD-LCTVs*., SID 02 Digest, pp. 68-70, 2002.

Baek-Woon Lee, Dongsik Sagong, and Gyuha Jeong, "41.5L: Late-News Paper: LCDs: How Fast is Enough?," SID 01 Digest, pp. 1106-1109, 2001.

* cited by examiner

SYSTEM FOR DISPLAYING IMAGES ON A DISPLAY

BACKGROUND OF THE INVENTION

The present invention relates to the processing of images for displaying on a display, and in particular to the processing of images for displaying images on a liquid crystal display.

Video images are displayed on various display devices such as Cathode Ray Tubes (CRTs) and Liquid Crystal Displays (LCDs). Typically such display devices are capable of displaying on a display screen images consisting of a plurality of picture elements (e.g., pixels) which are refreshed at a refresh rate generally greater than 25 Hertz. Such images may be monochromatic, multicolor, full-color, or combinations thereof.

The light of the successive frames which are displayed on the display screen of such a CRT or LCD display device are integrated by the human eye. If the number of displayed frames per second, typically referred to as the frame rate, is sufficiently high an illusion of the images being displayed in a continuous manner is created and therefore an illusion of motion may be created.

The technique in which images are formed on the display screen of a CRT display is fundamentally different from the way in which images are formed on the display screen of a LCD display. On a CRT display device the luminance of a picture element is produced by an area of a phosphor layer in the display screen where the area is struck by a writing electron beam. On a LCD display device, the luminance of a picture element is determined by the light transmittance state of one or more liquid crystal elements in the display screen of the LCD display device at the location of the picture element, whereby the light itself originates from ambient light or a light source. For accurate reproduction of moving images or moving parts of an image, the luminance response of the used display device is important.

The luminance responses and the luminance response times of CRT and LCD display screens are different. The luminance response time, being the time needed to reach the correct luminance on the display screen in response to an immediate change in a corresponding drive signal, is shorter than a frame period for a CRT display device but up to several frame periods for a typical LCD display device.

For LCD display device, the luminance responses and the luminance response times are different for a darker-to-brighter luminance transition as compared to the responses and response times for a similar brighter-to-darker luminance transition. Further, the luminance responses and luminance response times are temperature dependent, drive voltage range dependent, and, due to production tolerances, unequal over the LCD screen area (location dependent).

One existing technique to change the luminance response times with LCD display devices is to attempt to shorten the overall luminance response times by over-driving all the signals of the display for the slower of the transition of darker-to-brighter and brighter-to-darker. While of some benefit in increasing the temporal response of the display, the resulting image still includes some flickering. Flickering may be observed, in many cases, as apparent flickering of an image as the image is moved around on the display. Flickering tends to be most pronounced when an image is viewed on a shaded background with a dotted pattern as well as vector art often used in computer aided drawings.

Another existing technique to change the luminance response times with LCD display devices is to slow down the transition of all pixels of the display from the darker-to-brighter transition and the brighter-to-darker transition to the slowest transition within the display. This slowing down of the transition may be performed by modification of the driver waveform to achieve the slower temporal response. While slowing down the transition of all the pixels of the display results in a decrease in apparent flicker, unfortunately, the slowing down of the temporal response of the entire display result in objectionable motion blur because of the insufficient effective refresh rate.

EP 0 951 007 B1 disclose a de-flickering technique in which the video signal is modified so that the asymmetry of luminance rise and decay time is compensated. EP0 951 007 B1 is incorporated by reference herein. Referring to FIG. 1, FR which is representative of the present luminance output as it was predicted one frame before (previous frame) is subtracted from the input video signal. This difference and the present luminance output FR are the two inputs to the processing unit. The outputs of the processing unit are ΔC and ΔR, where ΔC is the new correction value to be added to the present predicted luminance FR, and ΔR is the new prediction of luminance change after the next frame.

K. Sekiya and H. Nakamura (IBM), in a paper entitled "Overdrive Method for TN-mode LCDs—Recursive System with Capacitance Prediction," SID'01, pp114-117; H. Nakamura and K. Sekiya (IBM), in a paper entitled "Overdrive Method for Reducing Response Times of Liquid Crystal Displays," SID'01, pp. 1256-1259; and H. Nakamura, J. Crain, and K. Sekiya (IBM), in a paper entitled "Computational Optimization of Active-Matrix Drives for Liquid Crystal Displays," IDW'00, pp.81-84; address some fundamental issues in overdrive technologies. These papers collectively suggest that while reducing the temporal response time of LCDs is the single goal in many overdrive technologies, the generally accepted definition of temporal response time is inappropriate, $$t_{response}=t_{arrival}-t_{start}$$

where $t_{arrival}$ is the time of the arrival point. The arrival point is defined as $$v_{arrival}=v_{start}+90\%\times(v_{target}-v_{start})$$

where $v_{start}$ is a starting brightness value and $v_{target}$ is a target brightness value. By this definition, the arrival point of the same target values varies by different starting values. Accordingly these papers suggest that if the difference between a starting and a target values is large, the arrival point is too offset from the target value.

These papers further suggest that the current overdrive technologies are ineffective because the overdrive technologies make the assumption that LC molecules in pixels always successfully transit from an equilibrium state to another equilibrium state within a driving cycle, and consequently ignore the fact that although an overdrive value is only applied to a pixel for one driving cycle, the overshot effect on that pixel lasts for several driving cycles. The current overdrive technologies typically store the brightness of a frame, and use a brightness-based lookup table.

To reduce these two problems, the papers proposed a new definition of temporal response time by re-defining the arrival point as a constant tolerance from a target value (gamma correction is considered), and a recursive overdrive scheme that stores internal capacitance of a frame. The papers suggest that the internal capacitance of a pixel plays a critical role in determining the brightness of the pixel, and therefore, internal capacitance of every pixel, but not the brightness of every pixel, should be stored. Because internal capacitance can not be obtained directly, it is estimated. Specifically, the estimation of a pixel's internal capacitance at time n is based on the previous estimation at time n−1 and the driving value at time n, resulting in a recursive implementation structure.

The papers further suggest phenomena in LCDs driven by most existing brightness-based overdrive technologies is that although an overdrive value applied to a pixel in one driving cycle makes the pixel reach a desired target value, if the normal driving value that is associated with that desired target value is applied to that pixel in the following driving cycles, the pixel surprisingly cannot sustain the target value that it achieved in the overdriving cycle, resulting in overshooting/undershooting effects in the following driving cycles. Brightness-based non-recursive overdrive schemes cannot solve this problem because they assume that an actual display value of a pixel can reach a target value and the LC molecules of that pixel reach an equilibrium state in an overdriving cycle, and this assumption is not true in reality. Although a pixel may achieve the desired target value in an overdriving cycle, the LC molecules of that pixel have not reached the corresponding equilibrium state.

According to the papers, the internal capacitance-based recursive overdrive scheme overcomes this problem. The scheme more precisely describes the intrinsic properties of TFT LCD by tracking the internal capacitance change, so it can better deal with the overshooting/undershooting effects in the brightness-based non-recursive overdrive schemes as follows:

Overshooting effect after an overdriving cycle: Upon the value of the estimated internal capacitance after an overdriving cycle, the new scheme has the capability of applying another overdrive in the reverse direction in the next driving cycle.

Undershooting effect after an overdriving cycle: Upon the value of the estimated internal capacitance after an overdriving cycle, the new scheme has the capability of applying another overdrive in the same direction in the next driving cycle.

As it may be observed, these papers use one-frame overdrive technologies based upon a model that assumes that transitions are always finished within a driving cycles, starting from an equilibrium state and finally ending at an equilibrium state. The recursive nature of the technique is internal to a single frame.

Furthermore, these papers are premised on the following theory. Charge (O) is injected into the display during a short time interval by applying a voltage and then the charge is held in the display by open-circuiting the charge source. Accordingly, the amount of charge Q is fixed during a frame. However, the applied voltage is changed to zero during the rest of the frame upon open-circuiting the source. Thus the capacitance of the pixel changes during the rest of the frame, namely Capacitance=Qinjected (which is fixed)/Vapplied (which is changing toward zero). The voltage maintained across the pixel changes with the changing capacitance, the luminance output then varies as related to the injected charge, which is dependent on the particular drive scheme being used to inject the charge. Accordingly, the capacitance model proposed above does not have an inherent 1 to 1 mapping between capacitance parameters and luminance values (e.g., a capacitance value can be related to multiple luminance values), which makes determining the appropriate values problematic.

K. Kawabe, T. Furuhashi, and Y. Tanaka (Hitachi), in a paper entitled "New TFT-LCD Driving Method for Improved Moving Picture Quality," SID'01, pp 998-1001, suggest that the existing ways to determine overdrive values, as to make actual display values and desired values as close as possible, cannot fully eliminate motion blur, because it fails to consider the effect of long transitions before reaching the desired values. In order to compensate for visual effects of long transitions, Kawabe et al. propose a dynamic contrast compensation (DCC) method with stronger overdrive values that make actual display values surpass the desired values, as illustrated in FIG. 2. In effect, to compensate for the inability of the display to achieve the desired values they suggest using a modified overdrive waveform.

Rho, Yang, Lee, and Kim (Korea), in a paper entitled "A New Driving Method For Faster Response of TFT LCD on the Basis of Equilibrium Charge Injection," IDW '00, pp. 1155-1156, suggest a theoretical description of the overdrive voltage as:

$$V_{overdrive} = \left(\frac{C_{LC-target} + C_s}{C_{LC-current} + C_s}\right) V_{target}$$

where $C_{LC\text{-}target}$ is the equilibrium capacitance of the next frame, $C_{LC\text{-}current}$ is the current capacitance, $C_s$ is the storage capacitance, and $V_{target}$ is the target voltage. If correct, this representation quantifies in some manner the value in using pixel capacitance.

Okumura, Baba, Taira, Kinno (Korea) in a paper entitled, "Advanced Level Adaptive Overdrive (ALAO) Method Applicable to Full HD-LCTVs," SID '02, model the LCD by a one-tap IIR filter. Then overdriving circuitry, as the inverse of the LCD response, is a one-tap FIR filter. Okumura, et al. suggest using the signal-to-noise (S/N) ratio by not applying the overdrive if the S/N of an input frame is too low (below a certain threshold). Okumura, et al. also propose the concept of dynamic resolution as an evaluation measure replacing widely used "temporal response time." It is noted that in K. Sekiya and H. Nakamura (IBM), in the paper entitled "Overdrive Method for TN-mode LCDs—Recursive System with Capacitance Prediction," SID'01, pp114-117, discussed above, address the same issue and propose a different solution, namely, re-defining the "temporal response time."

B-W Lee et. al., in a paper entitled "Reducing Gray-Level Response to One Frame: Dynamic Capacitance Compensation," SID '01, and B-W Lee et al., "LCDs: How fast is enough?" SID '01, pp1106-1109, subjectively tested motion artifacts and showed that: (1) even 0-response time LCDs can still have certain motion blur due to the hold-type display scheme; (2) when the response time of LCDs is reduced by less than half a frame, the quality of moving objects is almost as good as that of 0-response time LCDs. Specifically, "since the fastest change in today's video sources is 1/30 sec, the LCD's response needs to be within 1/60 sec."; (3) variation of operational temperature of LCD cells affects overdrive. "Since switching speed and dynamic capacitance change as a function of temperature, a set of compensation values measured at a certain temperature will yield different results at other temperatures."; and (4) over-compensated overshoot is similar to the edge enhancement technique. Accordingly, inaccurate overdrive voltages are not terribly accurate, due to many factors, such as the temperature.

JP 64-10299 disclose a LCD control circuit that compares the input data with the data written in the frame memory from the previous frame. Only in the event that the input data is larger than the stored data is corrective data determined. The corrective data is applied to the LCD control circuit to provide overdrive. JP 64-10299 specifically teach that in the event that the input data is smaller than the stored data, then the corrective data is not determined, but rather, the input data is provided directly to the LCD control circuit. The corrective data or the input data, depending on the comparison is provided to the frame memory. The JP 64-10299 reference tends to exhibit uneven edges in the image, a higher than expected contrast in different regions of the display, a lower than expected contrast in other regions of the display, a higher than expected increase in sharpness in some regions of the display, a lower than expected decrease in sharpness in other regions of the display, and a blurring of other portions of the display.

DETAILED DESCRIPTION OF THE PREFERRED EMBODIMENT

By way of background, the LCD has many advantages over the traditional CRT (Cathode Ray Tube). Unfortunately, as previously described the LCD has more severe motion blurs than CRT. The motion blurs of LCD are primarily the result of three factors:

(1) Slow movement/rotation of LC molecules in a pixel, resulting in slowly changing internal capacitance of a pixel and corresponding slow response of a pixel to its driving stimuli;

(2) Insufficient driving voltage or charge applied to a LC pixel, because the actual charging period of a pixel in AM-LCD is very short;

(3) Hold type drive and display scheme of LCD. In a CRT, a pixel is only lighted for a very short period once during a driving cycle, and is not lighted for the rest time, so CRT is called "impulse-type display." In the LCD, however, a pixel is always lighted. The brightness level of a pixel is changed in a very short period once during a driving cycle, and the brightness level is not changed for the rest time, so LCD is called "hold-type display."

The hold type characteristic (third factor) does not cause the slow temporal response of the LCD, and is independent from the slow movement/rotation of LC molecules and insufficient driving voltage (first two factors). The hold type characteristic (third factor) makes the motion blurry on LCD displays largely because the hold type impacts our human visual system by the human eye-tracking effect. Even if the LCD has the fastest 0 response time, motion blur will still exist because of the hold type display.

The slow movement/rotation of LC molecules and insufficient driving voltage (first two factors) are primarily responsible for the slow temporal response of LCD, which causes motion blur. The slow movement/rotation of LC molecules and insufficient driving voltage (first two factors) are correlated to one another. Specifically, the insufficient driving voltage or charge in the AM-LCD is caused by the AM-LCD driving scheme and the dynamic internal capacitance of the LC pixels.

In the AM-LCD driving scheme, every pixel has a very short charging period followed by a very long hold period within a driving cycle time. For example, usually the frame cycle time is 1/60 second with a charging period of a pixel usually less than 30 ms, and a holding period of about 1/50 second.

Figure 1:
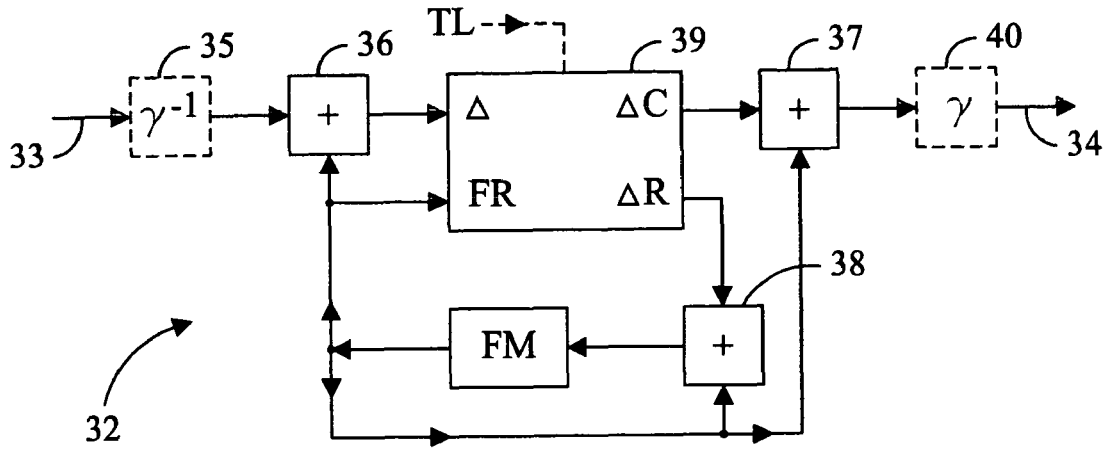
FIG. 1 illustrates an existing de-flickering technique.
Figure 2:
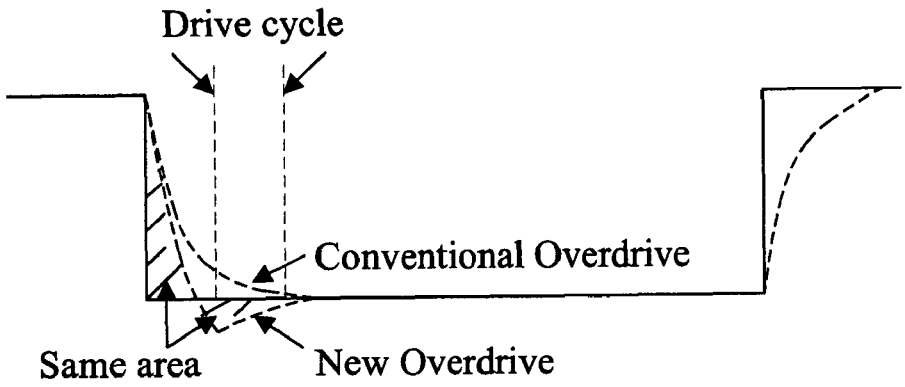
FIG. 2 illustrates a DCC technique.
Figure 3:
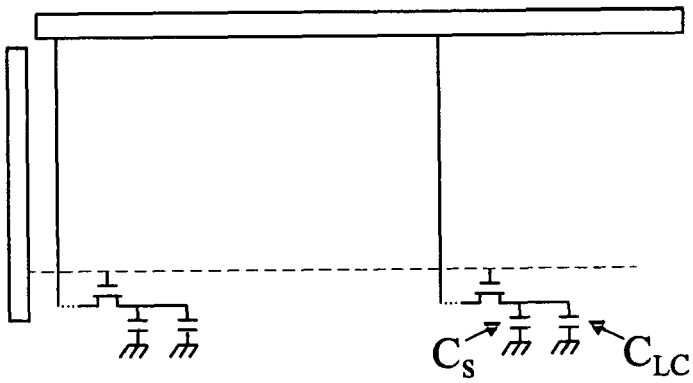
FIG. 3 illustrates one structure of an active matrix LCD.

During the charging period of a pixel, a driving voltage is applied to its gate transistor, and certain amount of charge is injected into the pixel. The amount of charge may be calculated as:

$$Q_{inject}=(C_{LC}+C_s)V_{input}$$

where $C_{LC}$ is the internal capacitance of a LC pixel, $C_s$ is the external capacitance of the capacitor connected to the LC pixel, and $V_{input}$ is the applied input voltage. Referring to FIG. 3, the two arrangement of the two capacitors is illustrated. During the holding period of a pixel, its gate is closed and the injected charge $Q_{inject}$ is held inside the pixel.

Figure 4:
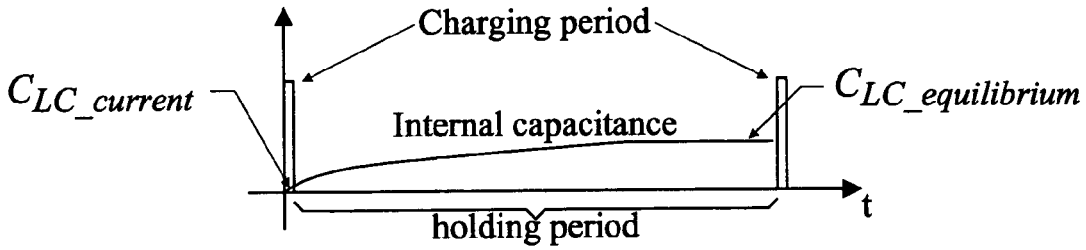
FIG. 4 illustrates the charging period versus internal capacitance changing period.

When a LCD device is showing a static content, where the same driving voltage is applied to a pixel in every driving cycle, certain display luminance of a pixel is always associated with certain driving voltage that is applied to that pixel. When a LCD device is showing a motion content, where different driving voltages are applied to a pixel in different driving cycles, however, simply applying a desired voltage to a pixel usually will not make a LC pixel yield the desired luminance associated with that voltage within one driving cycle. This inaccuracy in luminance output is because the internal capacitance of a pixel cannot finish its changing during the very short charging period of a driving cycle, and accordingly the capacitance of the pixel keeps changing in the long holding period, as illustrated in FIG. 4.

Typically, internal capacitance $C_{LC}$ keeps changing before the LC molecules inside the pixel reach an equilibrium state and their energy is minimized. The corresponding transition time ranges from several ms to several hundred ms. Because the charging period is very short (about 30 ms), $C_{LC}$ can be considered to be constant, denoted as $C_{LC_current}$. In the holding period, $C_{LC}$ changes away from $C_{LC_current}$ as the capacitance slowly changes. If one assumes that a LC pixel is capable of finishing a transition from one equilibrium state to another equilibrium state within a driving cycle time, then the new LC capacitance in the new equilibrium state is $C_{LC_equilibrium}$. Because the amount of charge injected to the LC pixel in the charging period $Q_{inject}$ does not change during the holding period, the voltage of the new equilibrium state of the pixel $V_{act}$ (actual) at the end of the holding period is different from the originally applied value $V_{input}$, $$V_{act} = \frac{Q_{inject}}{C_{LC_equilibrium} + C_s} = \left(\frac{C_{LC_current} + C_s}{C_{LC_equilibrium} + C_s}\right)V_{input}$$

If $V_{input}$ is associated with the desired luminance, the above equation illustrates that the final luminance associated with $V_{act}$ is different from the desired one.

From the above equation, it may be observed that as long as $C_{LC_current} \neq C_{LC_equilibrium}$, then $V_{act} \neq V_{input}$. Therefore, even if LC molecules could rearrange themselves several times faster than the ones in currently existing AM-LCD, such as LC molecules in OCB structure, as long as they could not reach an equilibrium state to make $C_{LC_current} = C_{LC_equilibrium}$ within the very short charging period, the actual voltage is still different from the input voltage at the end of the holding period.

Also from the above equation, it may be observed that increasing $C_s$ so that $C_s >> C_{LC}$ will make $V_{act}$ and $V_{input}$ closer and accelerate the response time. Alternatively, if $C_s$ is too large, then there is a risk that the charging period may not be long enough to inject sufficient charge in a pixel due to its internal resistance.

The conventional AM-LCD driving schemes directly use target voltages as input voltages of LC pixels, and inevitably make the actual voltages in LC cells different from input voltages. The overdrive technologies reduce the difference in the voltage by applying more driving voltage, which is different from target voltages, to LC pixels so that the desired luminance is reached at appropriate times. It is to be understood that other LCD types may likewise be used, in addition to other display technologies.

The existing overdrive technologies can be broadly categorized into two different categories:

(1) Injection of an appropriate amount of charge such as Level Adaptive Overdrive (LAO), Dynamic Contrast Compensating driving (DCC), Feedforward Driving (FFD), etc. The charge injected into a LC pixel is calculated so that the desired luminance of a pixel is emitted after the LC molecules rearrange themselves and reach equilibrium.

(2) Capacitively coupled drive (CCD): apply a voltage to a capacitor connected to a pixel electrode by the gate line. This method gives the gate a constant target voltage during a driving cycle time so that when internal capacitance CLC changes, the amount of charge can changes accordingly to keep the voltage constant. Essentially, this method extends the charging period.

The injection of the appropriate amount of charge (first type) overdrive technology is relatively straightforward to implement, and it compensates for voltage variations due to the dynamic LC internal capacitance CLC and accelerates the rearrangement of LC molecules. In contrast, the capacitively coupled drive (second type) overdrive technology is limited to certain type of panel architectures and the effect is limited.

Figure 5:
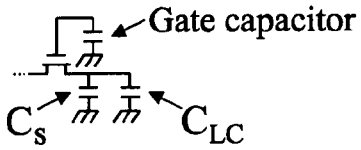
FIG. 5 illustrates a capacitively coupled drive.

Theoretically, by replacing the actual display $V_{act}$ with the target voltage $V_{target}$ in the previous equation, the drive voltage $V_{input}$ is the overdrive voltage $V_{overdrive}$, i.e., $$V_{overdrive} = \left(\frac{C_{LC_equilibrium} + C_s}{C_{LC_current} + C_s}\right)V_{target}$$

where $C_{LC_equilibrium}$ is the equilibrium capacitance of a pixel in the current frame, $C_{LC_current}$ is the internal capacitance of the pixel during the short charging period in the current driving cycle, $C_S$ is the storage capacitance, and $V_{target}$ is the target voltage of that pixel, as illustrated in FIG. 5. $C_{LC_equilibrium}$ may be determined by $V_{target}$, but $C_{LC_current}$ changes in accordance with the past history of driving voltages applied to the pixel. However, in many practical situations both $C_{LC_target}$ and $C_{LC_current}$ are unknown, so the applied overdrive voltages $V_{overdrive}$ are usually obtained experimentally.

Figure 6:
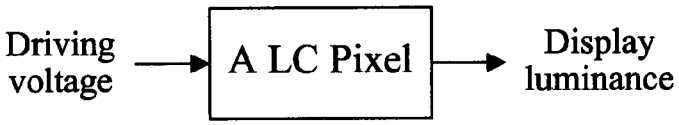
FIG. 6 illustrates a liquid crystal pixel as an input-output system.

In the development of an effective overdrive model the present inventors considered for previous capacitive limitations to further model a LCD. Theoretically, display luminance of a pixel can be modeled by driving voltage of the pixel with some physical parameters such as its internal capacitance. While this is theoretically possible, it turns out to be difficult to do in practice. The principal reasons are two fold: first the model is too complex and second, some internal parameters are difficult to measure. In light of such difficulties is was determined that a model of a LC pixel as an input-output system with input of voltage and output of light, as shown in FIG. 6 is more useful. It is noted that the system shown in FIG. 6 is not only time-variant but also highly non-linear. Without being required to know the physical structure of the system, one can measure the relations between the input and output, and then build a model for the time-variant and non-linear system.

Figure 7:
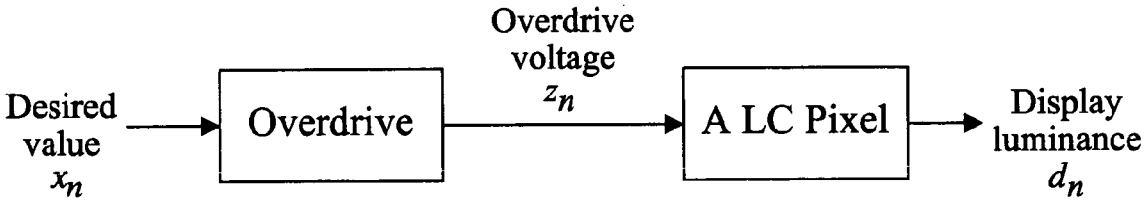
FIG. 7 illustrates an overdrive system.

The goal of an overdrive technique is to make the display luminance of a pixel at a moment close as much as possible to the desired value of that pixel at that moment. The overdrive is applied to the voltage being provided to the pixels of the LCD, as illustrated in FIG. 7. Preferably, an overdrive system should be the reverse system of a pixel display system so that the desired display value is the same as the actual display value. However, the desired display value is restricted by the following two factors: first, the preciseness of the pixel display model, and second, the realizability of the reverse model.

Figure 8:
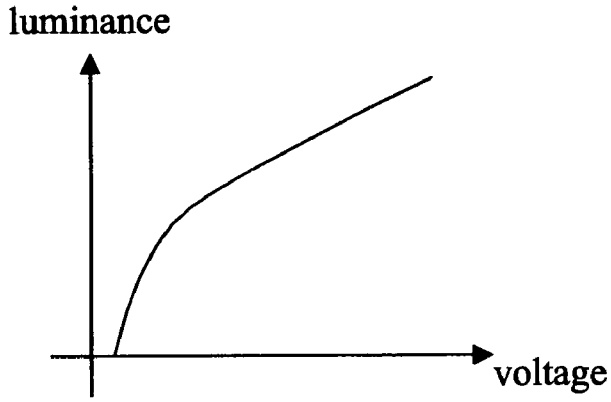
FIG. 8 illustrates the relation between luminance and voltage of a pixel in equilibrium states.

For convenience, the display luminance is frequently represented by a voltage. Because an equilibrium state of a pixel is the state in which the movements and positions of LC molecules inside a pixel have reached a balance, the driving voltage of a pixel and the display luminance of the pixel is one-to-one corresponded, as illustrated in FIG. 8. By using such a relation curve, any display luminance of a pixel, no matter whether the LC molecules of the pixel have reached their equilibrium state or not, can be uniquely represented by a voltage, which is corresponding to that luminance in the case that LC molecules have reach the equilibrium state. For convenience, the following description interchangeably uses luminance and voltage, may refer to them as "values".

Figure 9:
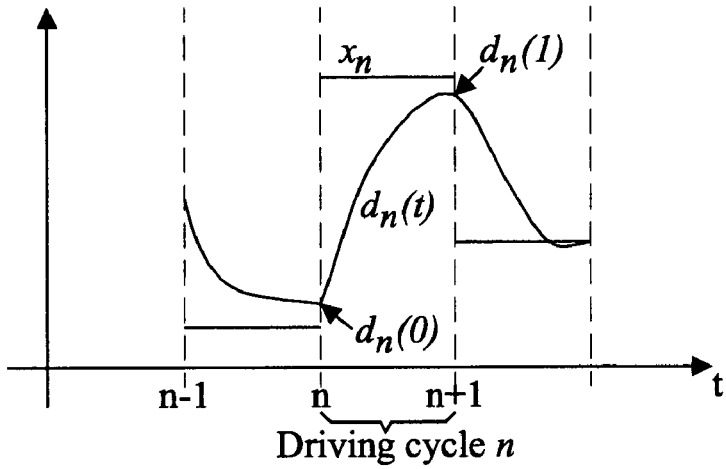
FIG. 9 illustrates desired display values, driving values, and actual display values.

The following three different values related to a pixel are frequently used in deriving the present model. Their relationships are shown in FIGS. 8 and 9.

The desired display value $x_n$ in driving cycle n:

$x_n$ is sometimes referred to as a code value, which is generally the value that is desirable to show on the LCD screen during driving cycle n. Driving cycle n starts from time n and ends at time n+1. In FIG. 9, $x_n$ is shown as a horizontal line.

The driving value $z_n$ in driving cycle n:

$z_n$ is sometimes referred to as the target value. In typical AMD-LCDs, $z_n$ is applied to a pixel only for a very short period of time (about 20 ms) in driving cycle n. In conventional non-overdrive schemes, $z_n$ and $x_n$ are the same; while in an overdrive scheme, $z_n$ and $x_n$ are different.

The actual display value $d_n(t)$ and $d_n$ in driving cycle n:

The actual display value $d_n(t)$ of a pixel in driving cycle n, before the pixel reaches an equilibrium state, is time-variant, where t (0<t<1) is the time index between time n and time n+1. It has been determined that one example of a suitable function that appropriately describes $d_n(t)$ is:

$$d_n(t)=f_d(t;z_n,z_{n-1},z_{n-2},\ldots,z_{n-p+1},z_{n-p})\ 0\leqq t<1$$

where $f_d(t)$ is a function, and p, not smaller than 1, is defined as the number of past frames starting from the previous equilibrium state. In other words, the pixel at time n−p+1, n−p+2, . . . , time n is not in an equilibrium state, and the pixel at time n−p is in an equilibrium state. The previous equation suggests that $d_n(t)$ is not only determined by the current driving value $z_n$, but also influenced by the past driving values before the previous equilibrium state. Usually, the influence of a past driving value decreases, as the driving value is further away from the current driving value.

The smaller p means better temporal response because it is faster for a pixel to transit from an equilibrium state to another equilibrium state. p itself is a variable and is affected by many factors, first, by $z_n$ and the history of the past driving values, secondly, by the LC state of the pixel (if the pixel is in the equilibrium state at time n−1, then p=1), and third, by the type of LCD. One or more of these factors may be considered, as desired.

The actual display value $d_n(t)$ of a pixel whose LC molecules have reached an equilibrium state at time n has the following characteristics:

(1) The driving value is the same as the actual display value and the desired value, i.e., $d_n(t)=z_n=x_n$ for $t'\leqq t<1$;

(2) If the next driving value is the same as the current one, then the pixel still keeps in the equilibrium state, i.e., if $z_{n+1}=z_n$, $d_{n+1}(t)=z_n=x_n$ for $0\leqq t<1$;

(3) If the next driving value is different from the current one, then the pixel moves away from the current equilibrium state. However, p for the next display value would be 1, i.e., $$d_{n+1}(t)=f_d(t;z_{n+1},x_n)\ 0\leqq t<1$$

From the above characteristics of an equilibrium state, because the pixel at time n−p is in an equilibrium state, then $z_{n-p}=x_{n-p}=d_{n-p}$. Consequently, $d_n(t)$ can be rewritten as $$\begin{aligned} d_n(t) &= f_d(t;\ z_n,\ z_{n-1},\ z_{n-2},\ \ldots\ ,\ z_{n-p+1},\ x_{n-p}) \\ &= f_d(t;\ z_n,\ z_{n-1},\ z_{n-2},\ \ldots\ ,\ z_{n-p+1},\ d_{n-p}) \quad 0 \le t < 1 \end{aligned}$$

where $z_{n-p}$ is replaced by $x_{n-p}$ and $d_{n-p}$.

The end display value in driving cycle n, $d_n(1)$, is the actual display value at time n+1, just before the new driving value $z_{n+1}$ is applied, as illustrated in FIG. 9. For convenience of notation $d_n(1)$ is replaced with $d_n$. Then by rewriting $d_n(t)$ one has:

$$d_n=d_n(1)=f_d(1;z_n,z_{n-1},z_{n-2},\ldots,z_{n-p})$$

where 1 is the final time index in driving cycle n.

The starting display value in driving cycle n $d_n(0)=d_{n-1}$ is the actual display value at time n.

The design of a conventional one-frame-buffer overdrive approach is that by applying appropriate $z_n$, the difference is minimized between the desired display value $x_n$ and the ultimate actual display value $d_n$, which is the display value just before the next driving value $x_{n+1}$ is applied at time n+1. $d_n$ is illustrated in FIG. 9. The difference can be measured by several suitable techniques. For example, one could use the mean-square-error (MSE) as the measure of the difference, then $z_n$ may be obtained by:

$$z_n = \underset{z_n}{\operatorname{argmin}}(d_n - x_n)^2$$

Because $z_n$ is more "aggressive" than $x_n$, this technique may be considered an overdrive technique. Different models use different methods to define $x_n$.

To simplify the problem, existing one-frame-buffer overdrive techniques assume that at the previous moment n−1 a pixel has reached an equilibrium state, i.e., p=1. As a result, $d_n$ can be simplified as:

$$d_n=f_d(1;z_n,x_{n-1})$$

Then $z_n$ may be determined as:

$$z_n = \underset{z_n}{\operatorname{argmin}}(d_n - x_n)^2 = \operatorname{argmin}(f_d(1;\ z_n,\ x_{n-1}) - x_n)^2$$

From the above equation, it may be observed that for a particular function $f_d$, $z_n$ is determined uniquely by the values of $x_n$ and $x_{n-1}$. It may further be observed that the minimum of $f_d$ is unique. Thus the function may be re-written as:

$$z_n=f_z(x_n,x_{n-1})$$

The current driving value in driving cycle n $z_n$ is determined by the current and previous desired display values, $x_{n-1}$ and $x_n$.

Figure 10:
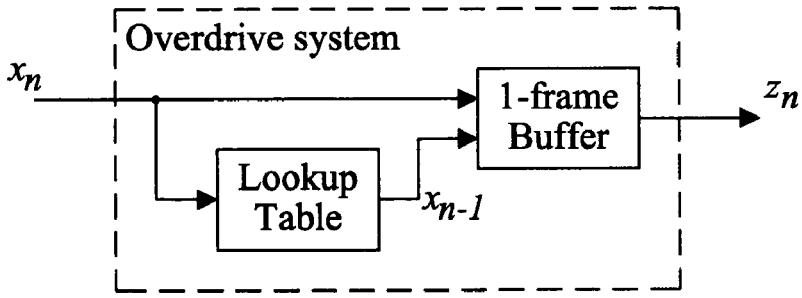
FIG. 10 illustrates one-frame buffer non-recursive overdrive.

A typical implementation structure of the conventional overdrive technology is shown in FIG. 10. The implementation requires one frame buffer, which stores the previous desired display value in driving cycle n−1 $x_{n-1}$, and a lookup table, which is frequently obtained through experimentation.

However, the present inventors came to the realization that the assumptions implicit within existing one-frame-buffer overdrive techniques are not valid. First, after overdrive, the actual value of a LC pixel usually is not the desired value $x_{n-1}$; secondly, in most cases a pixel fails to reach an equilibrium state.

One embodiment which improves the characteristics of the display involves using a one-frame-buffer recursive model, with the optimization criterion defined by:

$$z_n = \underset{z_n}{\operatorname{argmin}}(d_n - x_n)^2$$

This embodiment presumes that the LC molecules of the pixel have reached an equilibrium state in previous driving cycle n−1, so p=1. However, one may presume that the equilibrium state has the actual display values of a LC pixel in driving cycle n−1 $d_{n-1}$, but not necessarily the desired value $x_{n-1}$. As a result, $d_n$ may be written as:

$$d_n=f_d(1;z_n,d_{n-1})$$

Then, accordingly, the function of $z_n$ becomes $$z_n=f_z(x_n,d_{n-1})$$

Note that the difference between this function of $z_n$ and $$z_n=f_z(x_n,x_{n-1})$$

is that $x_{n-1}$ is replaced by $d_{n-1}$.

One difficulty in implementing $$z_n=f_z(x_n,d_{n-1})$$

is that the actual display value $d_{n-1}(1)$ is not directly available. Instead of inserting a hardware mechanism to measure luminance of every (or a selected portion of) pixel of a display, which is acceptable, one may measure the actual display values of a LCD for all (or a set of) possible driving values once, and then construct a LCD temporal response model based on the measurements for that particular LCD, which can give estimation of $d_n$ by:

$$d_n=f_{model}(z_n,z_{n-1},z_{n-2},\ldots,z_{n-p})$$

Figure 11:
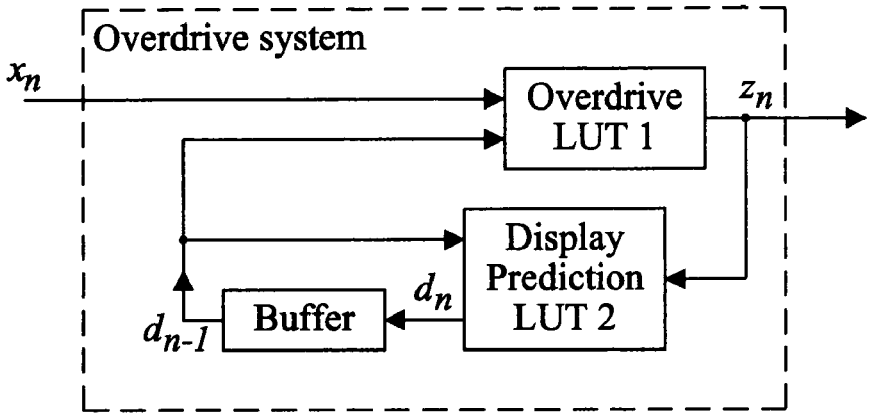
FIG. 11 illustrates one-frame buffer recursive overdrive.

$d_n$ is further simplified into a recursive form to be easy to implement as $$d_n=f_{model}(z_n,d_{n-1})$$

where the current actual display value $d_n$ is estimated from the current driving value $z_n$ and the previous actual display value $d_{n-1}$. One structure of the resulting one-frame-buffer recursive mode is shown in FIG. 11. The structure includes a pair of lookup tables. Look table 1 may be used to utilize:

$$z_n=f_n(x_n,d_{n-1})$$

determining the driving value $z_n$, and Look table 2 may be used to utilize $$d_n=f_{model}(z_n,d_{n-1})$$

estimating the actual display value $d_n$.

It is noted that the function of $z_n$ may be substituted into the function of $d_n$, to result in:

$$d_n=f_y(x_n,d_{n-1})$$

Figure 12:
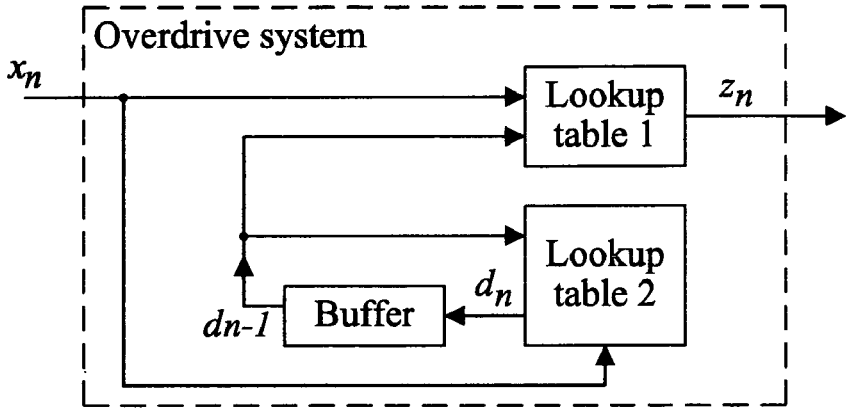
FIG. 12 illustrates a different embodiment of the one-frame buffer recursive overdrive model.

Accordingly, the block diagram may be modified as shown in FIG. 12.

The one-frame-buffer recursive model is a significant advancement over previously existing one-frame-buffer techniques. However, the aforementioned one-frame-buffer techniques the present inventors have determined still include the false assumption that the transition always starts from an equilibrium state. The existing techniques fail to recognize this limitation and accordingly are limited accordingly.

As illustrated, the recursive model feedbacks the estimated actual display value (or otherwise) so that the overdrive can adjust the next overdrive values accordingly. An example is presented to illustrate one particular implementation and the comparison to previous techniques.

Figure 13:
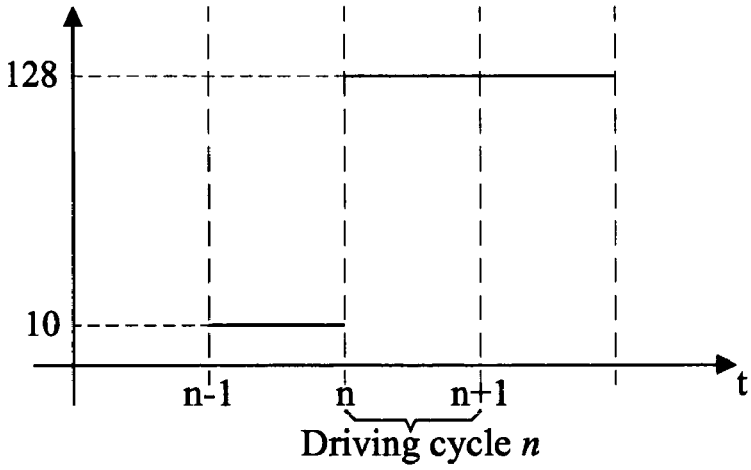
FIG. 13 illustrates desired display values.

In this example, the driving values $z_n$ and $z_{n+1}$ of a pixel have desired values $x_{n-1}=10$, $x_n=128$ and $x_{n+1}=128$, as illustrated in FIG. 13. An assumption is made that at time n−1, the pixel is in the equilibrium state, i.e., $x_{n-1}=z_{n-1}=d_{n-1}(t)=10$. A further assumption is that the temporal response from 10 to 128 takes several frame cycles even with overdrive, which is very common in existing LCDs. The following is the results from two different models.

The conventional overdrive model:

$z_n>128$ $z_{n+1}=128$. Because $x_n$ and $x_{n+1}$ are the same 128, overdrive is not necessary.

The recursive model:

$z_n>128$ $z_{n+1}>128$. Because after one frame cycle, $d_n(1)$ is still lower than $x_{n+1}$, overdrive is necessary.

The principal difference between the two models is at time n+1. This example shows that the recursive model is more powerful than the conventional model. When the one-frame overdrive does not significantly predict the appropriate value for the pixel to reach the desired value within one frame, the teachings embodied within the recursive model can apply a modified overdrive to make it faster than the conventional techniques reach the desired values.

In addition, it noted that the overdrive techniques described herein provide driving for both increased luminance and decreased luminance. The present inventors determined that appropriate driving in both directions tends to result in more even edges in the image, an expected contrast in different regions of the display, an expected sharpness in different regions of the display, and expected blurring of the display, unlike the technique taught by JP 64-10299.

As it may be observed, the modified one-frame-buffer recursive model typically uses an additional lookup tables than the existing one-frame-buffer techniques. Both models typically include a frame buffer. It is noted that the output of the additional lookup table and the contents of the buffer are typically estimated display values. It is also noted that the lookup tables may be replaced by any technique to estimate or otherwise predict the desirable values, such as a formula or system feedback from measurements.

The contents of the additional lookup table may be modified to provide a different output from the overdrive system representative of a different physical realization.

Modeling the LCD using the internal capacitance model was proposed by K. Sekiya and H. Nakamura (IBM), in a paper entitled "Overdrive Method for TN-mode LCDs—Recursive System with Capacitance Prediction," SID'01, pp114-117; H. Nakamura and K. Sekiya (IBM), in a paper entitled "Overdrive Method for Reducing Response Times of Liquid Crystal Displays," SID'01, pp.1256-1259; and H. Nakamura, J. Crain, and K. Sekiya (IBM), in a paper entitled "Computational Optimization of Active-Matrix Drives for Liquid Crystal Displays," IDW'00, pp.81-84. More specifically, the physical meaning of the output of lookup table 1 and the contents of the frame-buffer may be an estimate of the internal capacitance of the pixel, as opposed to the estimated actual display value of the pixel, which as discussed in the background results in having an ill defined mapping between capacitance parameters and luminance values, which makes determining the appropriate values problematic. An improved approach involves having a deterministic mapping between the lookup table values and the desired output luminance values, that is a function of the current input and the current state of the system.

Because the internal capacitance is a major factor causing the slow response of the display and if the internal capacitance model estimates the internal capacitance fairly precisely, the performance of the traditional internal capacitance model may be improved.

Another technique involves the output of lookup table 1 not being given any physical meaning, and treated as a parameter.

Without any physical meaning, lookup table 1 and 2 may be considered as two "black boxes" and may be filled with any contents as long as the final results are desirable. The lookup tables may be any type of tables, mathematical function, or otherwise. The black box model gives the system designer additional freedom to optimize the system than using other representations, such as for example, the estimated display value-based technique and the internal capacitance-based recursive technique. It is noted that the lookup tables may be one-dimensional and/or multi-dimensional, as desired.

As previously noted, the one-frame-buffer recursive or non-recursive overdrive models assume that p=1 and the transition starts from an equilibrium state of a pixel at the previous time. The present inventors have determined that this implicit assumption is not accurate and may lead to non-optimal solutions. With p>1 the effects of non-equilibrium may be taken into account. To achieve accurate results a modified system may minimize the difference between the actual display value $d_n$ and the desired value $x_n$ defined by:

$$z_n = \underset{z_n}{\operatorname{argmin}}(d_n - x_n)^2.$$

Then, the relationship may be written as:

$$z_n = \underset{z_n}{\operatorname{argmin}}(d_n - x_n)^2 = \underset{z_n}{\operatorname{argmin}}(f_d(1; z_n, z_{n-1}, \ldots, z_{n-p}) - x_n)^2$$

which yields $$z_n = f_z(x_n; z_{n-1}, z_{n-2}, \ldots, z_{n-p+1}, z_{n-p}).$$

One may presume that the pixel is in an equilibrium state at time n−p, then $z_{n-p}$ may be replaced with $x_{n-p}$. Therefore, $$z_n = f_z(x_n; z_{n-1}, z_{n-2}, \ldots, z_{n-p+1}, x_{n-p})$$

For the same reason, the previous driving value $z_{n-1}$ can be represented as $$z_{n-1} = f_z(x_{n-1}; z_{n-2}, z_{n-3}, \ldots, x_{n-p}).$$

This function about $z_{n-1}$ looks back p−1 steps. The function may be modified to look back fewer or more steps, as desired.

The driving value $z_{n-1}$ defined in the above equation may be substituted into the equation of $z_n$ defined by:

$$z_n = f_z(x_n; z_{n-1}, z_{n-2}, \ldots, z_{n-p+1}, x_{n-p})$$

this results in:

$$\begin{aligned} z_n &= f_z(x_n; f_z(x_{n-1}; z_{n-2}, z_{n-3}, \ldots, x_{n-p}), z_{n-2}, z_{n-3}, \ldots, z_{n-p}) \\ &= f_z^{(1)}(x_n, x_{n-1}; z_{n-2}, z_{n-3}, \ldots, z_{n-p+1}, x_{n-p}) \end{aligned}$$

where $f_z^{(1)}(.)$ represents a certain unknown function.

Figure 14:
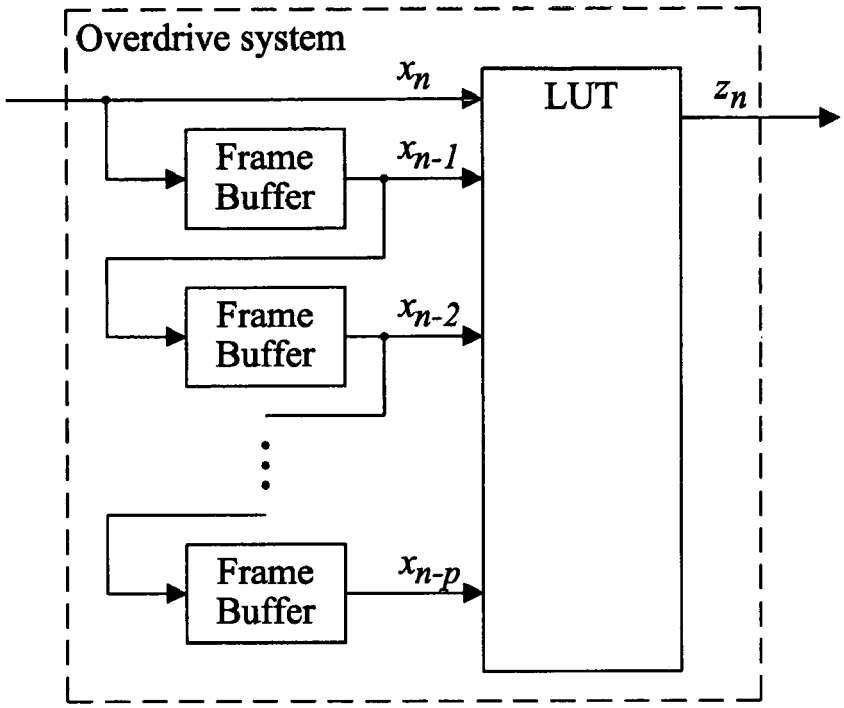
FIG. 14 illustrates a look-backward multi-frame buffer overdrive.

By replacing $z_{n-2}, \ldots, z_{n-p}$ the equation may be rewritten as:

$$z_n = f_z^{(p)}(x_n, x_{n-1}, x_{n-2}, x_{n-3}, \ldots, x_{n-p})$$

where $f_z^{(p)}(.)$ represents a function. This equation results in $z_n$ a function of values $x_{n-1}, x_{n-2}, \ldots, x_{n-p}$, thereby eliminating $z_{n-1}, z_{n-2}, \ldots, z_{n-p}$. One potential implementation structure is shown in FIG. 14. A total of p frame buffers may be used, as desired.

Similar to the one-frame-buffer recursive model, this model with p=2 may make $z_{n+1}$>128 in the previous example. The task is still to determine the driving values $z_n$ and $z_{n+1}$ of a pixel as desired values $x_{n-1}$=10, $x_n$=128 and $x_{n+1}$=128. In one implementation p=2 may be used.

A two-frame-buffer model is illustrated:

$z_n$>128.

$z_{n+1}$>128. Because $x_{n-1}$=10 and $x_n$=128 are buffered, from the training phase where the lookup table is defined, the model is able to predict that the pixel has no capability of jumping from 10 to 128 within one overdriving cycle n. Therefore, at least one more overdriving cycle n+1 is necessary. In contrast, the one-frame-buffer non-recursive model, because $x_{n-1}$=10 is not buffered, has no way to know that the overdriving cycle n tries to drive the pixel from 10 to 128 and fails. Accordingly, it may be observed that improved overdrive systems may be designed by incorporating two or more frame buffers for multiple frames (or a buffer including data from multiple different frames) and/or using data associated with multiple frames in addition to the current frame.

Although in the above examples, the two-frame-buffer look-forward model and the one-frame-buffer recursive model give the similar results at time n and n+1, the former is better than the later in many cases. One structural shortcoming of the recursive model (i.e., where the output of the display is an input to the overdrive system) is that the estimated actual display values are obtained from a recursive structure, and inherently the pixel system is not readily modeled by a recursive structure. Thus the estimation is rough. At the expense of an additional frame-buffer, the two-frame-buffer look-forward model may avoid the recursive structure.

As previously discussed, p is a variable in the design, and is selected based upon many factors such as LCD types, driving values, and the LC states. In typical implementations, however, the number of frame-buffer p is typically specified. Ideally it should be chosen to be the biggest one among all the possibilities. On the other hand, bigger p not only increases the size of memory, but also increases the size of lookup table (or otherwise).

Figure 15:
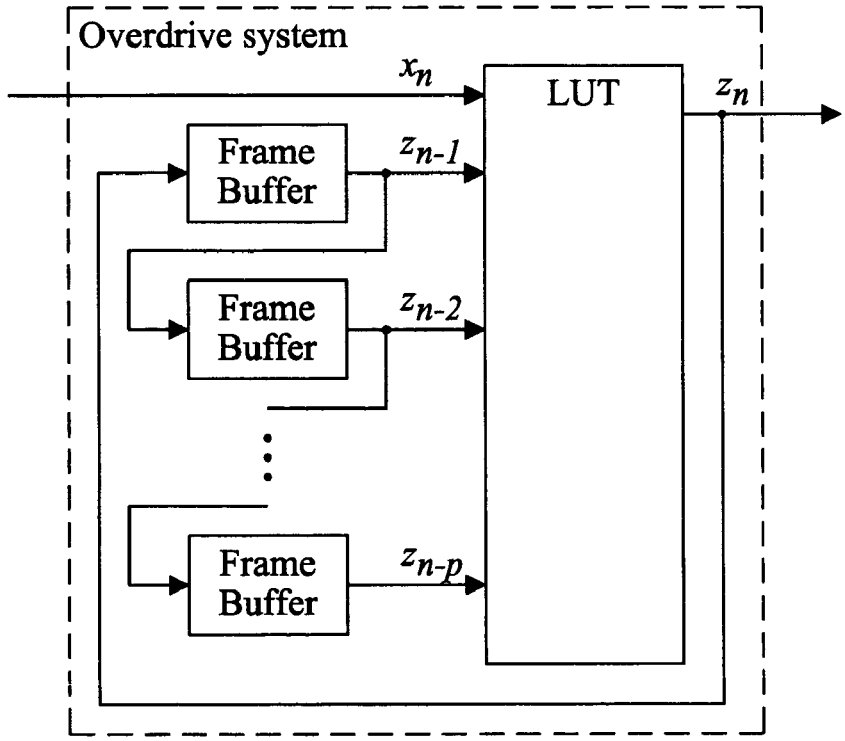
FIG. 15 illustrates another look-backward multi-frame buffer overdrive.

Different from the implementation structure shown in FIG. 14, the multi-frame buffer overdrive model also can be embodied as the structure shown in FIG. 15. In the structure shown in FIG. 14, the equation was modified by replacing $z_{n-1}, \ldots, z_{n-p+1}$ with $x_{n-1}, \ldots, x_{n-p+1}$. Here, instead, the equation was modified by replacing $x_{n-p}$ with $z_{n-p}$ because at time n−p, the pixel has presumably entered into an equilibrium state and $x_{n-p}=z_{n-p}$.

The principal purpose of previous models is to minimize the difference between the actual value and the desired value in the current driving cycle n, which is defined by, $$d_n(t) = f_d(t; z_n, z_{n-1}, z_{n-2}, \ldots, z_{n-p+1}, z_{n-p}) \quad 0 \leq t < 1.$$

The present inventors came to the realization that a look-forward and look-backward model may be used to minimize the overall difference between the actual values and the desired values for the current and next few driving cycles n, n+1, . . . , n+m. If a mean square error (MSE) is used as the measurement, then the equation is:

$$\sum_{l=n}^{n+m} (d_l - x_l)^2.$$

where l is the time index between current time n and future time n+m.

By minimizing $$\sum_{l=n}^{n+m}(d_l - x_l)^2,$$

Figure 16:
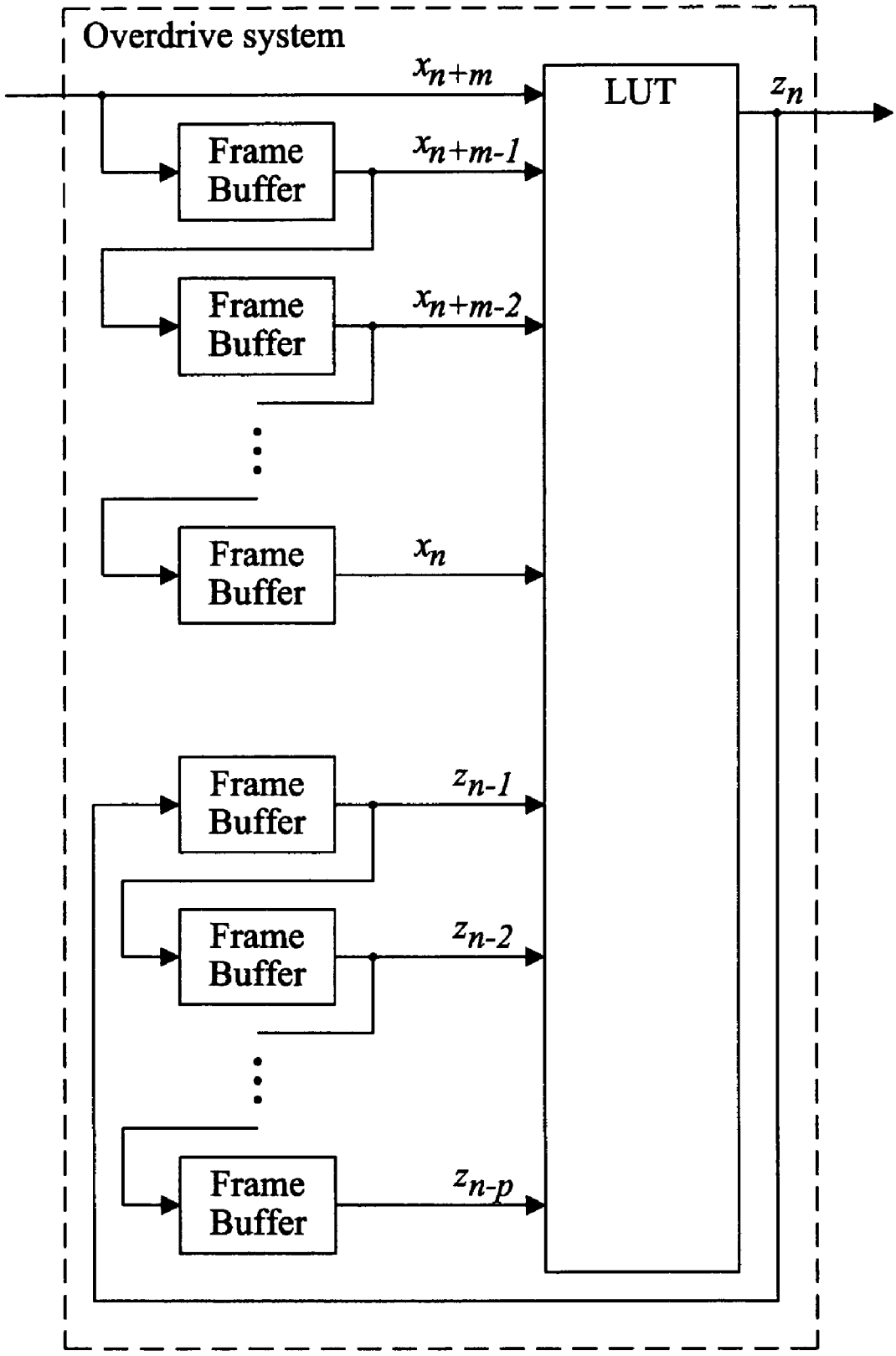
FIG. 16 illustrates a look-forward and look-backward multi-frame buffer overdrive.

$z_n, z_{n+1}, \ldots, z_{n+m}$ can be determined by $$\begin{aligned} z_n, z_{n+1}, \cdots, z_{n+m} &= \underset{z_n, z_{n+1}, \cdots, z_{n+m}}{\operatorname{argmin}} \sum_{l=n}^{n+m}(d_l - x_l)^2 \\ &= \underset{z_n, z_{n+1}, \cdots, z_{n+m}}{\operatorname{argmin}} \Big(\sum_{l=n}^{n+m}(f_d(1; \\ &\quad z_l, z_{l-1}, z_{l-2}, \ldots, z_{n-p}) - x_l)^2 \\ &= f_z(x_{n+m}, x_{n+m-1}, \ldots, x_{n+1}, x_n; \\ &\quad z_{n-1}, z_{n-2}, \ldots, z_{n-p+1}, z_{n-p}) \end{aligned}$$

where $f_z(.)$ is a certain unknown function. The previous equation shows that in the look-forward and look-backward model, the current and future driving values $z_n, z_{n+1}, \ldots, z_{n+m}$ is a function of current desired value $x_n$, future desired values $x_{n+1}, \ldots, x_{n+m}$, and past driving values $z_{n-1}, z_{n-2}, \ldots, z_{n-p}$. One or more such values may be used, as desired. One implementation is shown in FIG. 16. The look-forward and look-backward model, which is a non-causal system, may use two or more sets of buffers, one set for the future desired values and one for the past driving values.

The look-forward and look-backward model chooses current driving values not only to reduce the current error (in most cases) but also to reduce the future errors, i.e., an error distributed over time. This model provides the ability to include a human visual model, such as temporal CSF.

In one implementation, a lookup table may be used. Calculation of the content of the lookup table may be by optimization. One such technique involves replacing:

$$d_l = f_d(1; z_l, z_{l-1}, z_{l-2}, \ldots, x_{n-p})$$

in the optimization equation defined by $$\begin{aligned} z_n, z_{n+1}, \cdots, z_{n+m} &= \underset{z_n, z_{n+1}, \cdots, z_{n+m}}{\operatorname{argmin}} \sum_{l=n}^{n+m}(d_l - x_l)^2 \\ &= \underset{z_n, z_{n+1}, \cdots, z_{n+m}}{\operatorname{argmin}} \Big(\sum_{l=n}^{n+m}(f_d(1; \\ &\quad z_l, z_{l-1}, z_{l-2}, \ldots, z_{n-p}) - x_l)^2 \\ &= f_z(x_{n+m}, x_{n+m-1}, \ldots, x_{n+1}, x_n; \\ &\quad z_{n-1}, z_{n-2}, \ldots, z_{n-p+1}, z_{n-p}) \end{aligned}$$

with the LCD temporal response model $$d_l = f_{model}(z_l, z_{l-1}, z_{l-2}, \ldots, x_{n-p})$$

Next $z_n, z_{n+1}, \ldots, z_{n+m}$ may be determined. Trying out all the possible $z_n, z_{n+1}, \ldots, z_{n+m}$ and picking a combination that satisfies the equation but is computationally expensive. If $z_l$ has N possible values, then the computation is at the order of N.

If the following recursive simplification is used from the LCD temporal response model $$d_l = d_{l-1} + g_{model}(z_l)$$

where the current display values $d_l$ can be predicted by the previous display value $d_{l-1}$ and the current driving value $z_l$, then the Viterbi algorithm may be used to pick the optimal set of $z_n, z_{n+1}, \ldots, z_{n+m}$ in an efficient way. The procedure may be as follows (1) Starting from time n, try all the N values that $z_n$ possibly takes, which is indexed by i, calculate all the possible actual display values $d_n$ in the driving cycle n by $$d_n^{(i)} = f_{model}(z_n = i, z_{n-1}, z_{n-2}, \ldots, x_{n-p})$$

and for every possible driving value $z_n = i$, record $$\text{sum}_n^{min}(i) = (d_n(i) - x_n)^2$$

(2) For time n+1, calculate actual display values $d_{n+1}$ for all the possible driving values $z_{n+1}$ in the driving cycle n+1 by $$d_{n+1}^{(i,j)} = d_n^{(j)} + g_{model}(z_{n+1} = i)$$

where (i,j) indicates that this display value $d_{n+1}$ have the driving value of the $j^{th}$ value in the driving cycle n and the driving value of the $i^{th}$ value in the driving cycle n+1. Then, for the driving value $z_{n+1} = i$, calculate its minimum sum by testing all the N possible previous driving value $z_n = j$ and picking the minimum from $$sum_{n+1}^{min}(i) = \min_j\left(sum_n^{min}(j) + \left(d_{n+1}^{(i,j)} - x_{n+1}\right)^2\right)$$

Then record j that minimize the above equation as $j_{n+1}^{min}(i)$, and calculate $$d_{n+1}^{(i)} = d_{n+1}^{\left(i, j_{n+1}^{min}(i)\right)}$$

Figure 17:
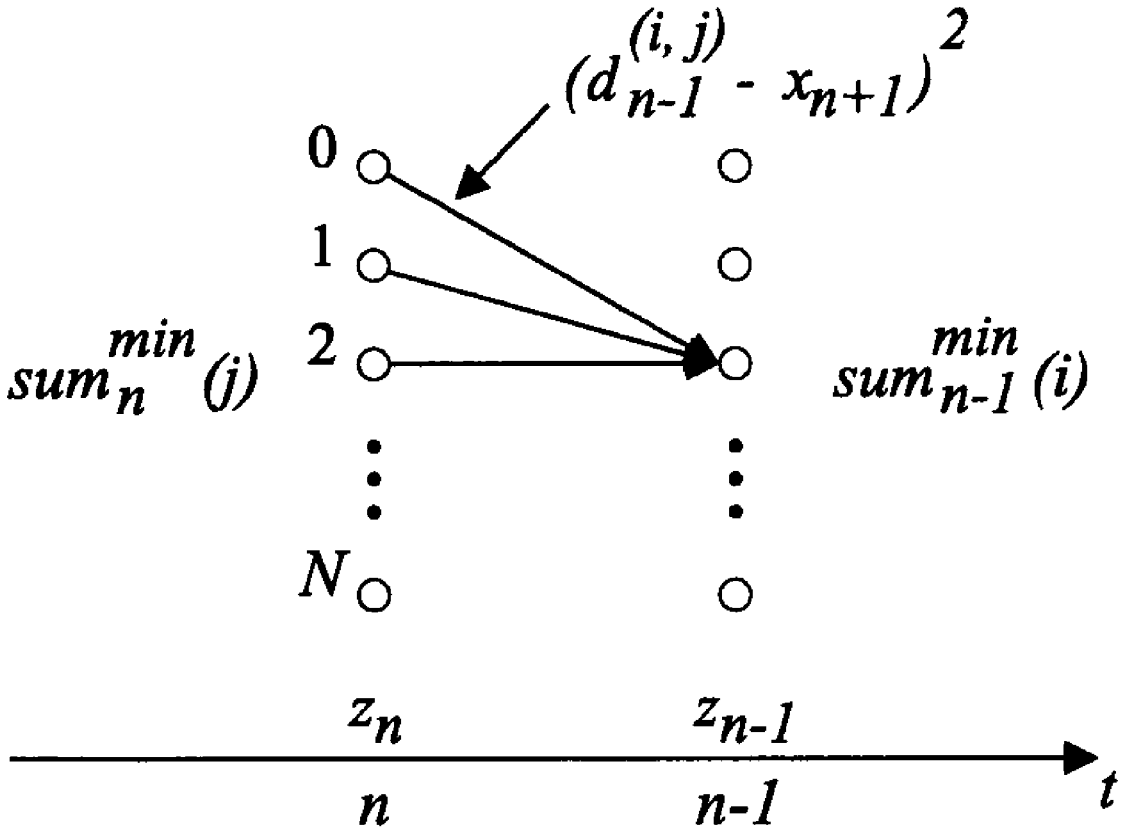
FIG. 17 illustrates a Viterbi algorithm.

This step is illustrated in FIG. 17.

(3) For any time l>n+1, repeat step 2 but replace all the time index n with l until l=n+m.

(4) For time n+m, $z_{n+m}$ is the value that minimize $$z_{n+m} = \underset{i}{\operatorname{argmin}} sum_{n+m}^{min}(i)$$

For other time l, $z_l = j_{l+1}^{min}(z_{l+1})$.

Figure 18:
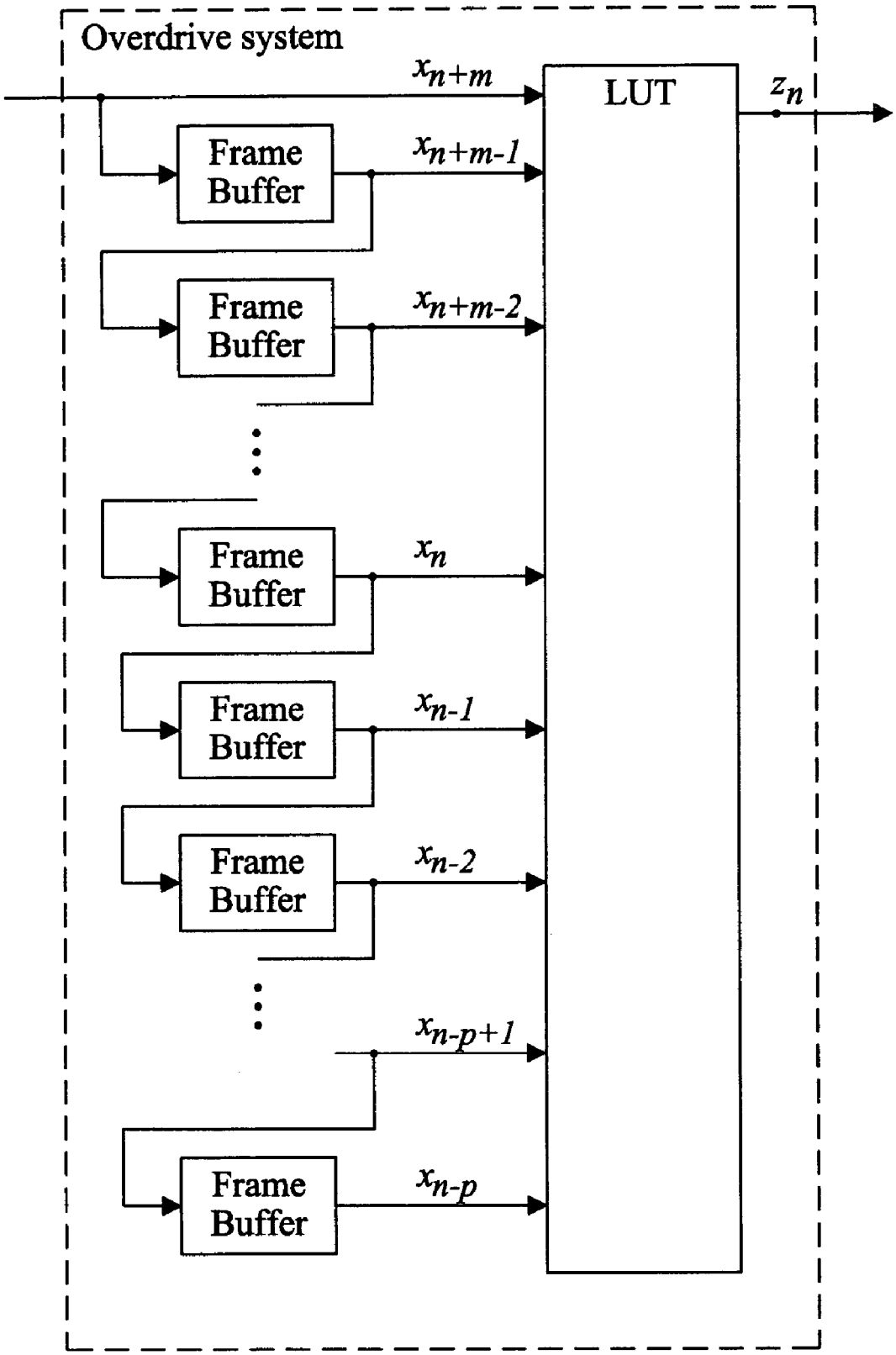
FIG. 18 illustrates another look-forward and look-backward multi-frame buffer overdrive.

One may replace $z_{n-1}, z_{n-2}, \ldots, z_{n-p}$ with $x_{n-1}, x_{n-2}, \ldots, x_{n-p}$, resulting in another embodiment as shown in FIG. 18, analogous to FIG. 15.

One of the principal overdrive tasks is to reduce motion blur. Although the human visual system is mainly sensitive to blurring on the moving edges, the present inventors realized that current overdrive technology treats all the pixels of a display screen equally. On the other hand, due to many factors, overdrive still cannot generally guarantee every pixel reaches its desired values, so overshoots or other visible undesired artifacts occasionally appear.

Figure 19:
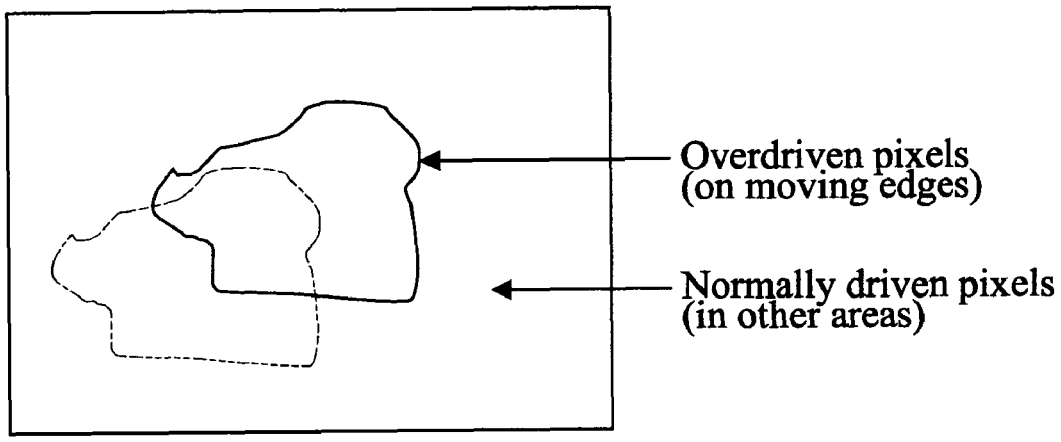
FIG. 19 illustrates moving edge boosting.

To reduce these unpleasant artifacts, an "edge boosting" effect may be employed. Specifically, the system selectively overdrives the pixels of the moving edges detected in the frame (e.g., image), and drive the remaining pixels normally. In FIG. 19, the solid curve in the current frame moves from the dashed curve in the previous frame. Therefore, preferably only pixels on the solid curve are overdriven, and the remaining pixels are not overdriven.

Figure 20:
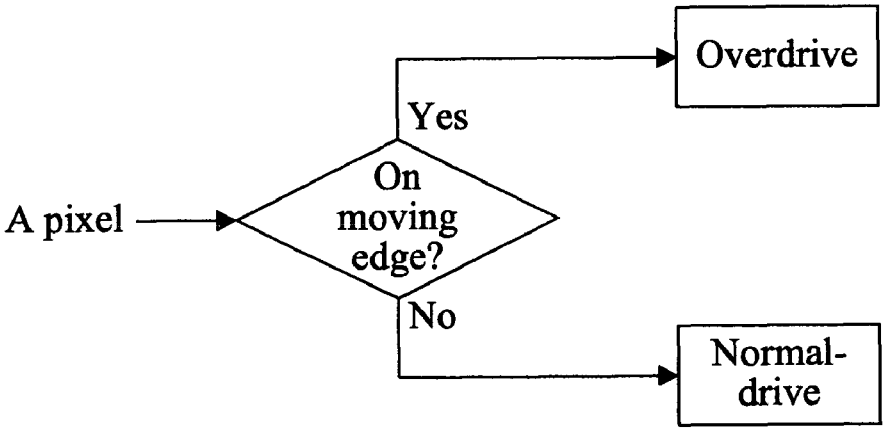
FIG. 20 illustrates the use of different driving method between a detected moving edge pixel and a non-moving edge area pixel.

One structure of edge boosting is shown in FIG. 20. A pixel is checked if it is on a moving edge. If the pixel is on a moving edge, then some overdrive technology is used. If the pixel is not on any moving edge, then no overdrive is used. Note that edge boosting can be used with any overdrive models.

Figure 21:
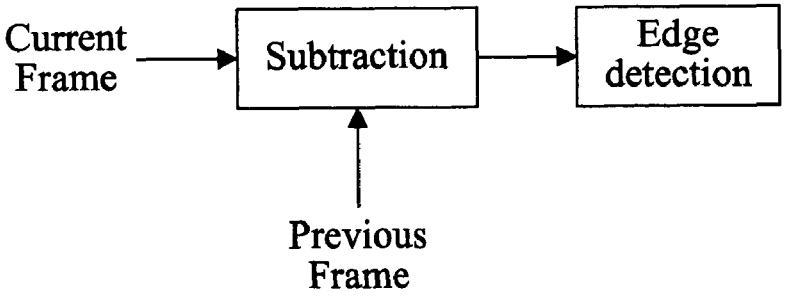
FIG. 21 illustrates edge boosting.

There are many ways in which to detect a moving edge. As shown in FIG. 21, first the current frame may be subtracted from the previous frame; then an edge detection algorithm is applied to the subtracted frame. The computational cost but not accuracy of an algorithm is primary concern in many implementations. For example, one may use a Prewitt edge detection method. The two 2-D convolution kernels of Prewitt detection are

| | | |
|---|---|---|
| −1 | −1 | −1 |
| 0 | 0 | 0 |
| 1 | 1 | 1 |
| −1 | 0 | 1 |
| −1 | 0 | 1 |
| −1 | 0 | 1 |

The first kernel aims at detecting horizontal edges and the second kernel aims at detecting vertical edges. Finally, the detected moving edge image is binarized. Only those pixels with 1 are considered to be moving edges and are therefore overdriven.

Other types of overdrive systems may likewise be provided that characterize the content of the image in some manner, such as for example, those regions of the image that include high movement, low movement, moving edges, stationary edges, color content, texture, etc. After characterizing the content of the image, based upon the image itself or upon a plurality of different images, the overdrive technique may be selectively applied to different pixels of the display in response thereto. This provides a benefit in the ability to selectively apply the overdrive.

Referring again to FIG. 10, the non-recursive overdrive model is typically implemented using one frame buffer, which stores previous target display values $x_{n-1}$ in driving cycle n−1, and an overdrive module, which takes current target display value $x_n$ and the previous display value $x_{n-1}$ as input to derive the current driving value $z_n$ so that the actual display value $d_n$ is the same as the target display value $x_n$. As previously described, the current display value $z_n$ is not only determined by the current driving value $x_n$ but also by the previous display value $x_{n-1}$. It may be observed that the display value $x_n$ and $x_{n-1}$ are available without any calculations, and therefore the overdrive calculation function be readily implemented with limited memory and computational resources.

Referring again to FIG. 11, the one-frame buffer recursive overdrive model involves a pair of calculations. The calculations involve determining $x_{n-1}$ and estimating the display value $d_n$. In typical implementations, the use of two different calculations each of which have similar calculation complexity will result in doubling the system complexity (e.g., number of gates) compared to the non-recursive model. In most cases, each of the calculations is implemented in the form of a two-dimensional look up table, with interpolation. The implementation thus involves a pair of two-dimensional look up tables having the same size (i.e., the same number of entries/order of function).

While considering the computational complexity and the two different calculations, the present inventors came to the realization that there is sufficient computational redundancy within the two functions that optimization may be performed. As an initial matter, the two tables represent different aspects of the estimation, namely, over-drive calculation and display prediction, and accordingly may not need the same level of detail. For example, in some implementations it may be sufficient for the display prediction to have 12 the number of entries as the overdrive calculation. In this manner, a reduction in the memory requirements and computational complexity may be achieved.

The present inventors also came to the realization that the display prediction does not need to be calculated when the overdrive calculation module drives the display values to the target value, i.e., $d_n=x_n$. This saves computational complexity of the system by avoiding the need to perform the overdrive calculation. In many cases, the overdrive calculation is performed when the system attempts to drive the pixel to the desired value as fast as possible. In order to drive the pixel to the desired value as fast as possible, normally the pixel is provided with a value of 0 (minimum) (or substantially) or 256 (maximum) (or substantially). Consequently, when the driving value is not the minimum (e.g., 0) or maximum 256 (maximum) the system may presume that the display will reach its desired value. In addition, to ease computational complexity the system may also presume that the display will reach its desired value when the driving value is substantially the minimum (e.g., <25) or maximum (e.g., >231) (e.g., +/−10% of scale) (based on 0 to 256 scale).

In the case that the overdriving value(s) are known, such as 0 (minimum) or 256 (maximum), or substantially the minimum/maximum (e.g., +/−5%, +/−10%, +/−15% of range), then it has been determined that the display prediction may further be simplified. For the non-overdriven case the system may use the output of the overdriven calculation $z_n$ for the buffer value. For the overdriven case, such as when the value is 0 or 256 the system may use a pair of one-dimensional tables (or a simplified two-dimensional table) to calculate the display prediction. In this manner, the intermediate values between 0 and 256 do not need to be calculated by the display prediction module. This results in a significant reduction in the size of the tables needed for the display prediction.

Figure 22:
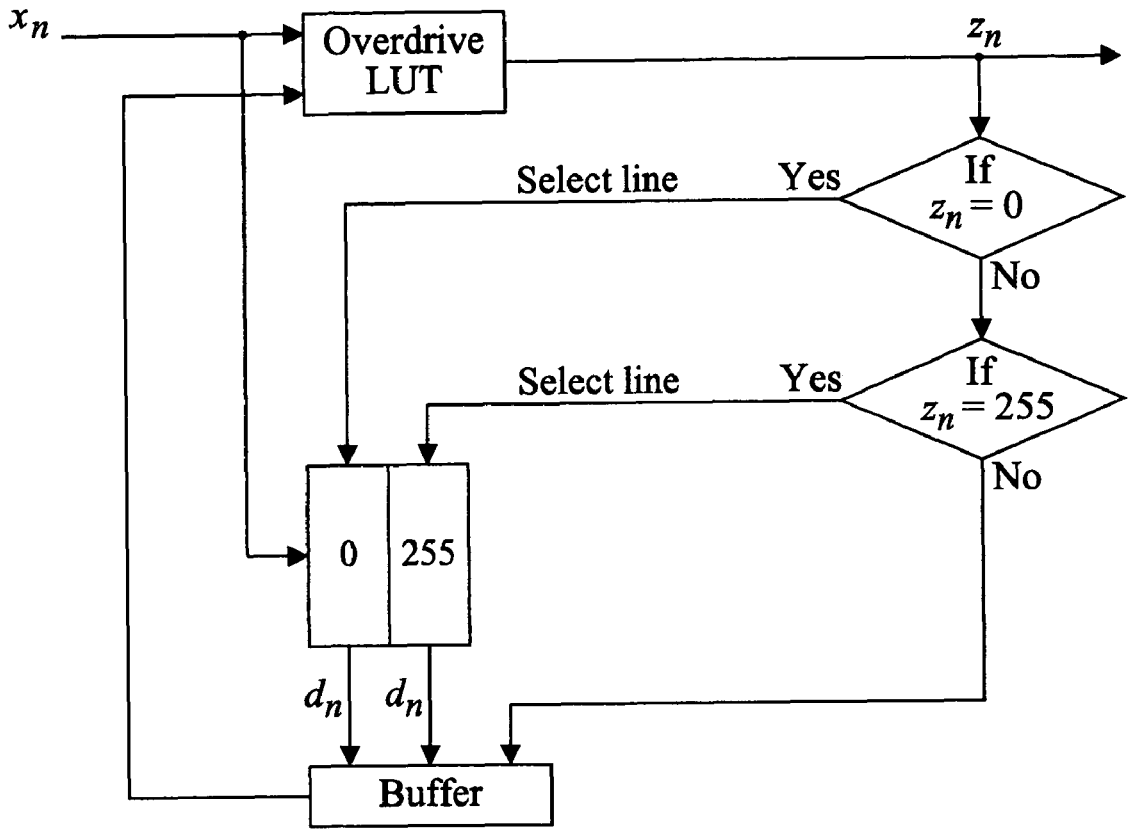
FIG. 22 illustrates a modified overdrive system.

Referring to FIG. 22, one implementation is shown. The output of the overdrive calculation is checked to see if it is zero. If the output is zero (minimum), then the "zero" select line is selected which is associated with a one-dimensional table having values associated with "zero". If the output is 255 (maximum) then the "max" select line is selected which is associated with a one-dimensional table having values associated with "maximum". If the output is neither zero (minimum) or 255 (maximum) then the output of the overdrive calculation is provided to the buffer directly. This direct output is for the case in which the system reaches the desired value (e.g., equilibrium). The input $x_n$ to the overdrive calculation operates on the selected look up table, namely, either the "zero" table or the "maximum" table. The output of the look up tables is $d_n$, which is provided to the buffer. The buffer in turn provides $d_{n-1}$ to the overdrive calculation.

Figure 23:
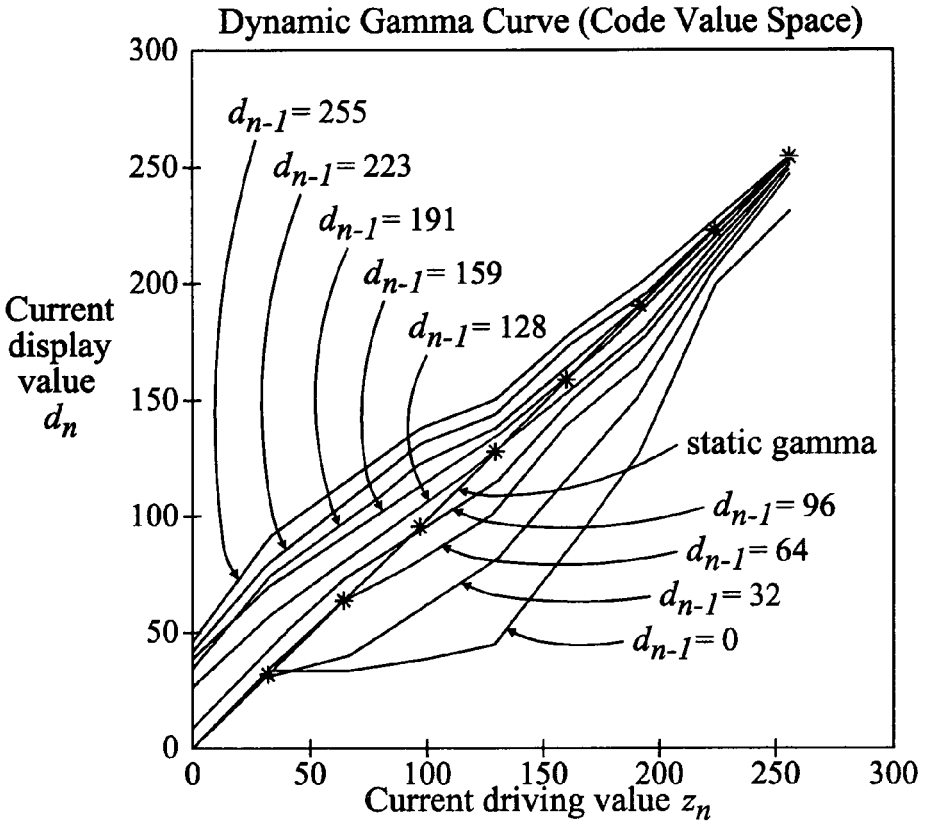
FIG. 23 illustrates current display value versus current driving value.

More specifically, the "dead regions" of LCD responses may be when a prediction calculation is needed. A "dead region" may be defined as the region in which the target values cannot be reached by overdrive for a particular previous display value. FIG. 23 shows that for any previous display value $d_{n-1}$, two or one dead regions of current display values $d_n$ will never be reached, because the overdrive value $z_n$ cannot go beyond 0 and 255. Specifically, if the previous display $d_{n-1}$ is 0, then there is one dead region that cannot be reached and the dead region is at the high end of code values.

If the previous display $d_{n-1}$ is 255, then there is one dead region that cannot be reached and the dead region is at the low end of code values.

If the previous display $d_{n-1}$ is between 0 and 255, then there are two dead regions that are at both high and low ends.

The following is an example using data shown in FIG. 23 corresponding to the above three cases.

If the previous value $d_{n-1}$ is 0, then current display value $d_n$ cannot be over 224 because the driving value $z_n$ cannot be higher than 255. Therefore, for a target value $x_n$ below 224, appropriate driving values $z_n$ can be found to help reach the target value $x_n$; but for a target value $x_n$ above 224, although the maximum driving value $z_n$=255 is used, the target value $x_n$ are still not achieved, and the actual display value $d_n=f_d(255,d_{n-1})$.

If the previous value $d_{n-1}$ is 255, the current display value $d_n$ cannot be lower than 40 because the driving value $z_n$ cannot be lower than 0. Therefore, for a target value $d_n$ above 40, appropriate driving values $z_n$ can be found to help reach the target value $x_n$; and for a target value $x_n$ below 40, even with minimum driving value $z_n$=0, the target value $x_n$ is still not achieved, and the actual display value $d_n=f_d(0, d_{n-1})$.

If the previous value $d_{n-1}$ is 128, then the current display value $d_n$ cannot be the two regions higher than 245 and lower than 26.

From the above example, it may be observed that one feature that distinguishes if a target value $x_n$ is reached is overdriving value $z_n$. If overdriving value $z_n$ is 0 or 255, then target value $z_n$ is not reached; otherwise, the target value $z_n$ may be reached and prediction calculation is not needed.

Figure 24:
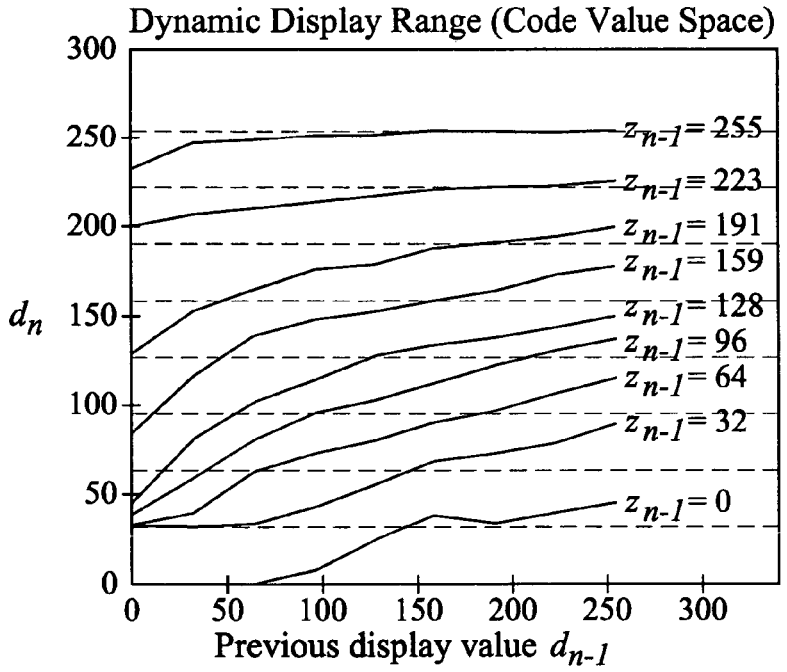
FIG. 24 illustrates dynamic display ranges.

Another issue is the calculation of the prediction value in a computationally efficient manner when prediction calculation is indeed needed. When the target value $x_n$ cannot be reached, the driving values are likely either 0 or 255 (or substantially). Therefore, only $d_n=f_d(0,d_{n-1})$ and $d_n=f_d(255, d_{n-1})$ need to be calculated, which is a substantial reduction in complexity. Referring to FIG. 24, the 9 curves represent $d_n=f_d(0,d_{n-1})$, $d_n=f_d(32,d_{n-1}), \ldots, d_n=f_d(255,d_{n-1})$ with the top and the bottom curves of most interest.

$D_n=f_d(0,d_{n-1})$ and $d_n=f_d(255,d_{n-1})$ can be readily implemented in an FPGA/ASIC as two one-dimensional lookup tables (LUTs). The two one-dimensional lookup tables are potentially more accurate than $d_n=f_d(z_n,d_{n-1})$ implemented as a two dimensional look up table. The latter is a two dimensional function which is much harder to measure and is less accurate to calculate than two one-dimensional functions.

Figure 25:
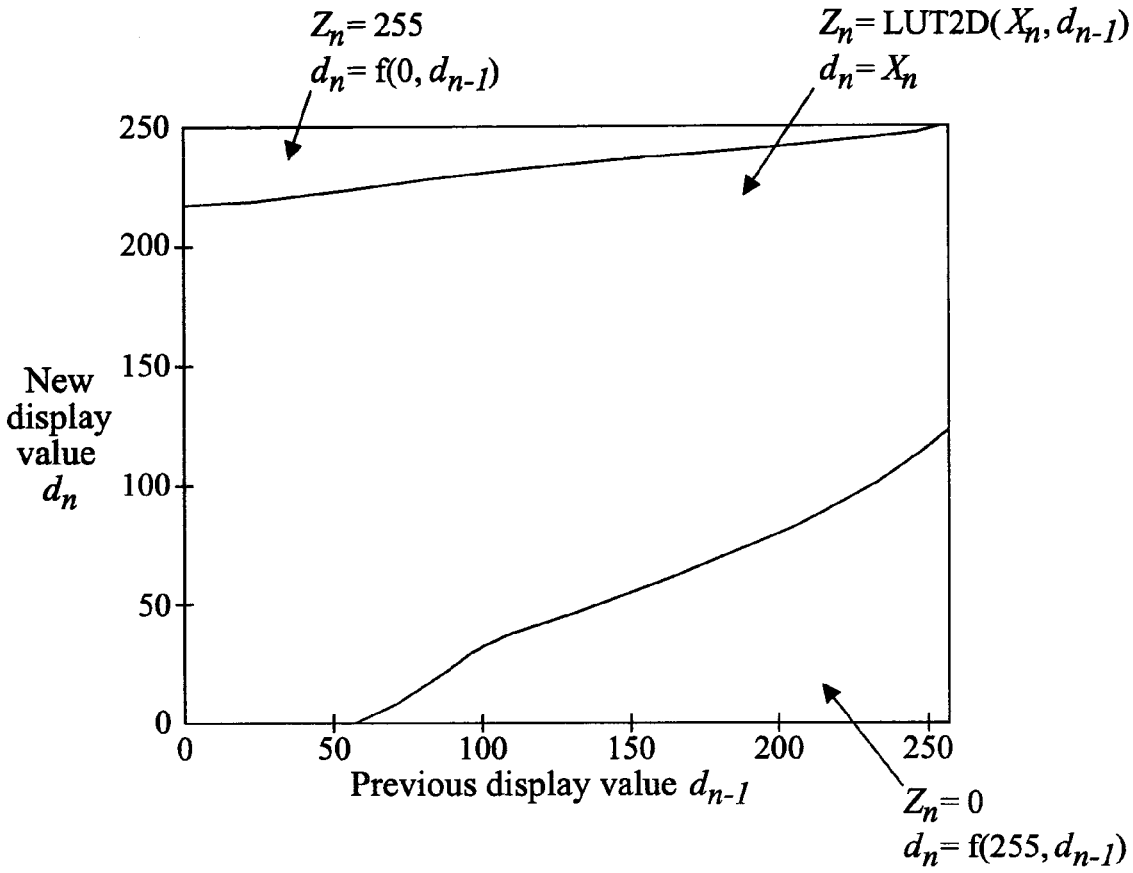
FIG. 25 illustrates new and previous display values.
Figure 26:
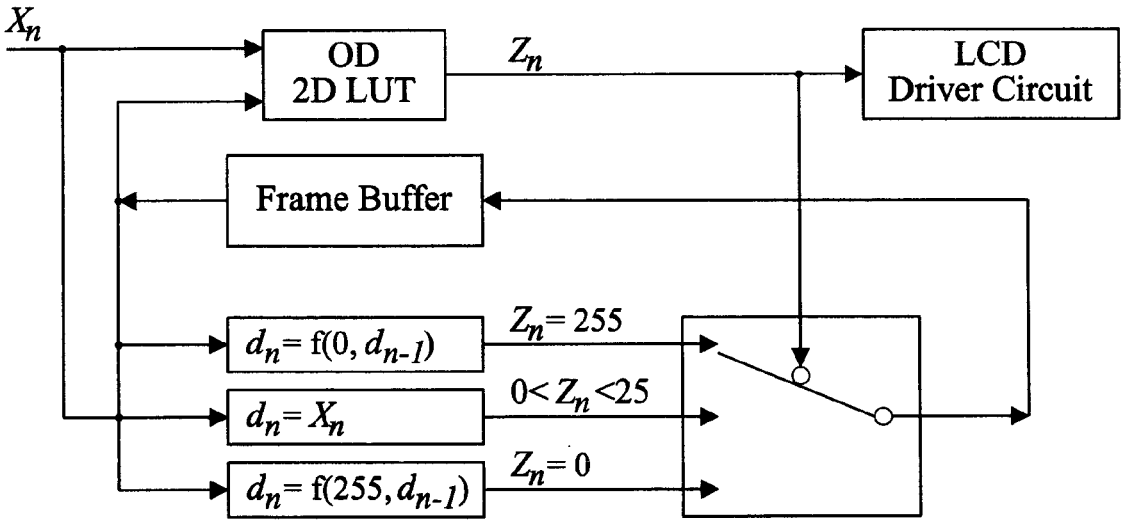
FIG. 26 illustrates a modified recursive model.

FIG. 25 shows the three regions for predicting the display output value. Accordingly, only the boundaries are needed to determine the display output. Another implementation structure is shown in FIG. 26. Compared to the structure shown in FIG. 11, the modified structure shown in FIG. 26 uses a switch mechanism to select the value that is going to be stored in the frame buffer. $D_n=f_d(0,d_{n-1})$ and $d_n=f_d(255,d_{n-1})$ can be implemented by a one dimensional lookup table (LUT), which is more computationally efficient than implementing a two-dimensional LUT as shown in FIG. 11. If the overdrive calculation module is implemented in one chip of ASIC or FPGA, only a small number of gates are needed. The predicted $d_n$ can also be derived from a single parametric function such as linear function, or polynomial functions with three sets of coefficients.

Figure 27:
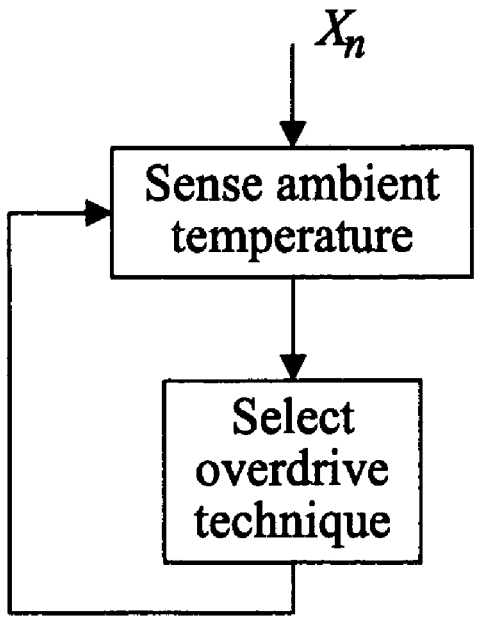
FIG. 27 illustrates temperature sensing.

After further consideration the present inventors came to the realization that the operational characteristics of the LCD varies with temperature and that, in turn, the desirable overdrive being applied likewise varies with temperature. For example, in cold conditions the LCD material tends to respond slower to applied voltages than in warm conditions. Referring to FIG. 27, the LCD device preferably includes a temperature sensor, or otherwise the capability of determining the ambient temperature. Based upon the ambient temperature the system may select among several different overdrive techniques, or otherwise modify values of an overdrive technique. Also, the system may select between applying an overdrive technique(s) or otherwise not providing an overdrive technique. For example, the overdrive technique may be selected based upon 5 degrees centigrade and normal room temperature.

Figure 28:
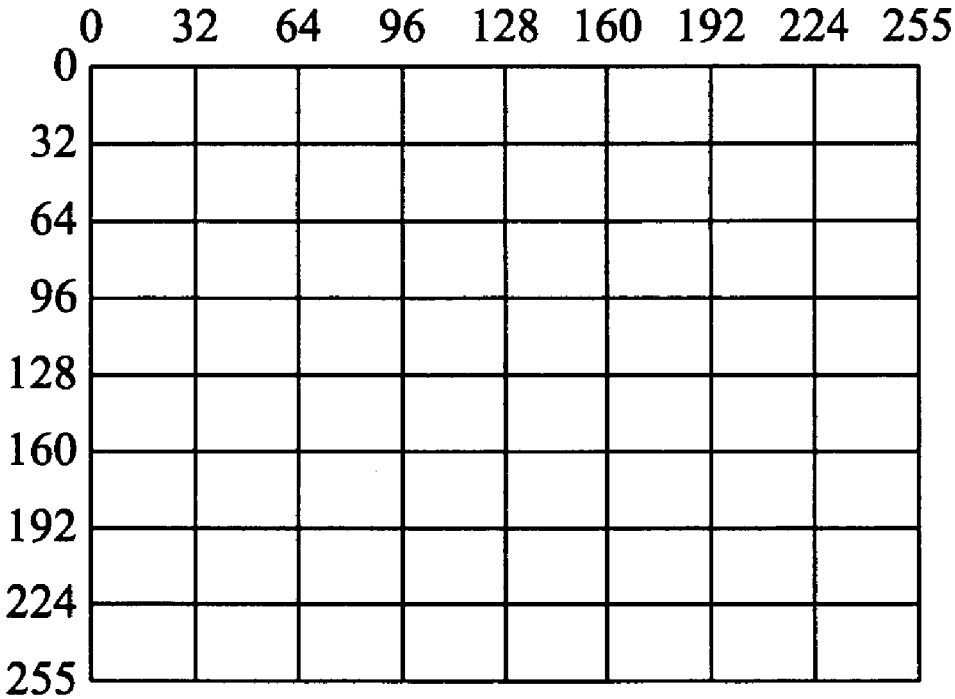
FIG. 28 illustrates a look up table.

The typical implementation involves the use of lookup tables, such as the one shown in FIG. 28. In the event that the value desired from the lookup table falls on one of the x and y grids, such as 32 x and 64 y, then the value may be simply selected from the table. However, in most cases the desired value is not on the grid but rather is somewhere in between 2 (horizontal or vertical) or 4 different provided values. In this case, typically the system interpolates, e.g. linear interpolation, an appropriate values from those available in the table, such as 35 x and 35 y. While this is an appropriate technique, the present inventors observed that the $1^{st}$ column is likely a set of zeros (minimum value) and the last column is a set of 255s (maximum value). Within the table one typically employs linear interpolation but the display itself tends to be highly non-linear, especially in the regions near the minimum and maximum display values. As it may be observed on FIG. 23, many of the driving situations do not reach the 0,0 point or the 255,255 point, but are rather truncated somewhere short of those points. When the values in the table are inserted as 0 or 255, for those truncated regions, they tend sufficiently off from what values are necessary to achieve the desired result. Accordingly, when performing interpolation in the regions near the maximum or minimum, the values are likely off from what are necessary to achieve the desired result.

To assist in obtaining more accurate values when performing the interpolation, the present inventors determined that toward the minimum region some of the values should be negative (or otherwise less than what is to be provided to achieve a zero voltage (e.g., minimum)) to that after interpolation a more accurate value will be provided. In the case that the interpolated value is less than zero, the system may reset the value to zero, if desired, since the display is typically incapable of displaying a negative value.

To assist in obtaining more accurate values when performing the interpolation, the present inventors also determined that toward the maximum region some of the values should be in excess of maximum (or otherwise more than what is to be provided to achieve a 255 voltage (e.g., maximum)) to that after interpolation a more accurate value will be provided. In the case that the interpolated value is greater than maximum, the system may reset the value to maximum, if desired, since the display is typically incapable of displaying a value greater than the maximum.

It is to be noted that the techniques discussed herein may likewise be applied to other display technologies that have different temporal responses dependent upon the changes in intensity.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

What is claimed is:

1. A method of modifying a video image comprising a plurality of sequential frames to be displayed on a display;

(a) receiving at least a portion of a current frame of said video image; and (b) modifying said current frame to alternatively increase or decrease the luminance output of a portion of said display corresponding to a pixel of said current frame, by overdriving a voltage to said portion to a current driving value for display in said current frame, said current driving value automatically selected based upon:

(i) at least one predicted displayed luminance value of said pixel in respective ones of at least one frame subsequent to said current frame of said video image; and (ii) at least one previously displayed luminance value of said pixel in respective ones of at least one frame previous to said current frame of said video image; where (c) said current driving value is calculated to reach a non-equilibrium displayed luminance value in said current frame used to predict said at least one predicted displayed luminance value of said pixel in said at least one frame subsequent to said current frame.

2. The method of claim 1 wherein said at least one previously displayed luminance value of said pixel is stored in a respective frame buffer.

3. The method of claim 2 where a first said previously displayed luminance value is at a state where liquid crystal material associated with said pixel of said display is not at an equilibrium state, and where a second said previously displayed luminance value is at a state where said liquid crystal material associated with said pixel is at an equilibrium state, and where said second said previously displayed luminance value is from the earliest said at least one frame, upon which selection of said current value is based.

4. A method of modifying an image to be displayed on a display;

(a) receiving at least a portion of said image; and (b) modifying said image to alternatively increase or decrease the luminance output of a pixel of said image by overdriving said pixel to a current driving value for display in said current frame, said current driving value selected based upon:

(i) at least one predicted displayed luminance value of said pixel in respective ones of at least one subsequent frame of said image; and (ii) at least one previously displayed luminance value of said pixel in respective ones of at least one previous frame of said image, wherein said at least one previously displayed luminance value of said pixel is stored in a respective frame buffers; where (c) a first said previously displayed luminance value is at a state where liquid crystal material associated with said pixel of said display is not at an equilibrium state, and where a second said previously displayed luminance value is at a state where said liquid crystal material associated with said pixel is at an equilibrium state, and where said second said previously displayed luminance value is from the earliest said at least one frame, upon which selection of said current value is based.

* * * * *

UNITED STATES PATENT AND TRADEMARK OFFICE

CERTIFICATE OF CORRECTION

PATENT NO. : 8,049,691 B2
APPLICATION NO. : 10/676312
DATED : November 1, 2011
INVENTOR(S) : Hao Pan et al.

It is certified that error appears in the above-identified patent and that said Letters Patent is hereby corrected as shown below:

Col. 9, Line 22

Change "$d_n(t) = f_d(T; Z_n, Z_{n-1}, Z_{n-2},\ldots,Z_{n-p+1}, Z_{n-p})0 \leqq t < 1$"

to read: --$d_n(t) = f_d(T; Z_n, Z_{n-1}, Z_{n-2},\ldots, Z_{n-p+1}, Z_{n-p})0 \leq t < 1$--:

Col. 9, Line 45

Change: "$d_n(t) = z_n = x_n$ for $t' \leqq t < 1$"

to read: --$d_n(t) = z_n = x_n$ for $t' \leq t <$--;

Col. 9, Line 48

Change "$z_{n+1} = z_n$, $d_{n+1}(t) = z_n = x_n$ for $0 \leqq t < 1$"

to read: --$z_{n+1} = z_n$, $d_{n+1}(t) = z_n = x_n$ for $0 \leq t < 1$--;

Col. 9, Line 54

Change: "$d_{n+1}(t) = f_d(t; z_{n+1}, x_n)0 \leqq t < 1$"

to read: --$d_{n+1}(t) = f_d(t; z_{n+1}, x_n)0 \leq t < 1$--.

Signed and Sealed this
Thirty-first Day of January, 2012

David J. Kappos

David J. Kappos
*Director of the United States Patent and Trademark Office*

Col. 11, Line 39

Change: "$z_n = f_n(x_n, d_{n-1})$"

to read: --$z_n = f_g(x_n, d_{n-1})$--.

Col. 14, Line 53

Change: "$d_n(t) = f_d(t; Z_n, Z_{n-1}, Z_{n-2},..., Z_{n-p+1}, Z_{n-p})0 \leqq t < 1$"

to read: --$d_n(t) = f_d(t; Z_n, Z_{n-1}, Z_{n-2},..., Z_{n-p+1}, Z_{n-p})0 \leq t < 1$--.

Col. 14, Lines 62-63

After the equation, remove the ".".

Col. 15, Line 61

Change: "If $z$," to read --if $z_i$--.

Col. 15, Line 63

Change: "N." to read --$N^m$--.

Col. 16, Line 13

Change: "$\text{sum}_n^{min}(i) = (d_n(i) - x_n)^2$" to read --$\text{sum}_n^{min}(i) = (d_n^{(i)} - x_n)^2$ --.